US007778575B2

(12) United States Patent
Matsuda et al.

(10) Patent No.: US 7,778,575 B2
(45) Date of Patent: Aug. 17, 2010

(54) IMAGING APPARATUS ADJUSTING A ROTATIONAL STOP PHASE BASED ON A CALCULATED ROTATIONAL PHASE

(75) Inventors: Yuji Matsuda, Tokyo (JP); Yasuhisa Ehara, Kanagawa (JP); Kazuhiko Kobayashi, Tokyo (JP); Joh Ebara, Kanagawa (JP); Noriaki Funamoto, Tokyo (JP); Seiichi Handa, Tokyo (JP); Hiromichi Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 136 days.

(21) Appl. No.: 11/687,095

(22) Filed: Mar. 16, 2007

(65) Prior Publication Data

US 2007/0217830 A1 Sep. 20, 2007

(30) Foreign Application Priority Data

Mar. 17, 2006 (JP) ..... 2006-075652

(51) Int. Cl.
*G03G 15/00* (2006.01)
*G03G 15/01* (2006.01)

(52) U.S. Cl. ..... 399/167; 399/301

(58) Field of Classification Search ..... 399/167, 399/298, 299, 301–302; 347/115–116
See application file for complete search history.

(56) References Cited

U.S. PATENT DOCUMENTS 5,995,802 A * 11/1999 Mori et al. ..... 399/394
6,390,588 B1 * 5/2002 Ikeda ..... 347/19
2004/0179870 A1 * 9/2004 Mitsuya et al. ..... 399/301
2005/0047834 A1 * 3/2005 Tomita et al. ..... 399/301
2006/0056868 A1 * 3/2006 Ebara et al. ..... 399/49
2007/0127937 A1 * 6/2007 Ichikawa et al. ..... 399/49

FOREIGN PATENT DOCUMENTS

JP 9-146329 6/1997
JP 2003-145836 5/2003
JP 2005-266425 9/2005

OTHER PUBLICATIONS

U.S. Appl. No. 11/677,013, filed Feb. 20, 2007, Kobayashi et al.

* cited by examiner

*Primary Examiner*—David M Gray
*Assistant Examiner*—Gregory H Curran
(74) *Attorney, Agent, or Firm*—Oblon, Spivak, McClelland, Maier & Neustadt, L.L.P.

(57) ABSTRACT

An imaging apparatus is disclosed that includes plural image carriers on which different-colored toner images are formed, the image carriers being driven and rotated to transfer the different-colored toner images onto one of an endless transfer member that is driven to rotate in contact with the image carriers or a transfer material that is carried by the endless transfer member. The imaging apparatus includes a phase calculating unit that extracts a periodic rotational variation component of each of the image carriers from a combination of periodic rotational variation components generated within said imaging apparatus and calculates a rotational phase of each of the image carriers based on the extracted periodic rotational variation component, and a rotational phase adjusting unit that adjusts a rotation stop phase of each of the image carriers based on the calculated rotational phase.

13 Claims, 17 Drawing Sheets

IMAGING APPARATUS ADJUSTING A ROTATIONAL STOP PHASE BASED ON A CALCULATED ROTATIONAL PHASE

BACKGROUND OF THE INVENTION

1. Field of the Invention

The present invention relates to an imaging apparatus.

2. Description of the Related Art

With recent advancements in the quality and speed of administrative paperwork at the office, for example, there is a growing demand for a color imaging apparatus such as a copier, a printer, or a facsimile machine with higher image quality and higher processing speed. A tandem color imaging apparatus is one type of imaging apparatus that is being developed in view of such a demand. For example, the tandem color imaging apparatus may include image forming units for the colors black (K), yellow (Y), magenta (M), and cyan (C), and may be configured to form a color image by transferring the different color images created by the image forming units in an overlapping manner onto a transfer material or an intermediate transfer medium that moves across the image forming units. It is noted that various types of the tandem color imaging apparatus have been proposed and developed into commercial products.

For example, FIG. 1 is a diagram illustrating an exemplary configuration of an electrophotographic direct transfer tandem color imaging apparatus as one type of a conventional tandem imaging apparatus.

In this example, latent images that are created on the surfaces of photoconductor drums 40Y, 40M, 40C, and 40K by a laser exposure unit (not shown) are developed by a developing unit (not shown) so that corresponding toner images (developed images) may be created. The photoconductor drums 40Y, 40M, 40C, and 40K having the toner images formed thereon are each rotated at a predetermined rotational speed by a gear decelerating mechanism (not shown) and a drive motor (not shown). The toner images are successively transferred and layered onto recording paper that is adhered to a conveying belt 210 by electrostatic force to be conveyed by the conveying belt 210 after which the toner of the transferred images is heated and pressurized by a fixing apparatus 213 so that a color image may be formed on the recording paper. The conveying belt 210 is arranged over a drive roller 211 and a driven roller 212 that are positioned parallel to each other with suitable tension. The drive roller 211 is rotated at a predetermined rotational speed by a drive motor (not shown), and in turn, the conveying belt 212 moves at a predetermined speed. The recording paper is fed to the conveying belt 212 at a predetermined timing by a paper feeding mechanism and is conveyed by the conveying belt 212 to move at the same speed as the conveying belt 212 so that an image may be formed thereon.

In the tandem color imaging apparatus as is described above, color drift may occur depending on the positioning of the images formed by the image forming units. Color drift may be caused by the relative deviations in the transfer positions of the different color images that are layered on top of each other at the recording paper. When such color drift occurs, a thin line image that is formed by layering plural color images may appear blurred, or white spots may be created around the periphery of a black character image when such black character image is set within a background image that is formed by layering plural color images, for example.

It is noted that color drift may be influenced by a constant component (DC component) that occurs on a constant basis and a variable component (AC component) that varies over the rotation period of a rotating element such as the photoconductor drum or the belt drive roller. The variable component occurring over the rotation period of the photoconductor drum may be primarily caused by transmission errors of a drive transmission system arranged at the photoconductor drum shaft (e.g., transmission errors caused by gear eccentricity and/or gear cumulative pitch deviation) or transmission errors of a coupling element that detachably couples the photoconductor drum to the drive transmission system (e.g., transmission errors caused by shaft tilting and/or shaft center deviation), for example.

In a tandem imaging apparatus, there may be variations in the amplitudes and phases of the positional deviation variable components (i.e., deviation from the desired transfer position) of the image forming units over a predetermined section of the transfer belt (i.e., transfer area covered by one rotation of each photoconductor drum), and such variations may lead to image quality degradation. Specifically, color drift variations may be reduced when relative positional deviations between different colors with respect to a given color are reduced. For example, with regard to color drift variable components, when the phases of the positional deviation variable components of a black image forming unit and a yellow image forming unit are the same, the positional deviation variable components may act to cancel out color drift variations between these colors. On the other hand, color drift variations are maximized when the phases of the positional deviation variable components differ by 180 degrees.

In the following, color drift variable components are described in greater detail with reference to FIGS. 2A and 2B. FIG. 2A is a diagram illustrating positional deviations of a photoconductor drum of the conventional tandem imaging apparatus. FIG. 2B is a diagram illustrating a positional deviation variable component of the conventional tandem imaging apparatus.

In FIG. 2A, even when the ON/OFF timing of light irradiated from a write unit 214 onto the surface of the photoconductor drum 40K according to an image pattern is constant, variations may occur in the rotational speed of the photoconductor drum 40K when there eccentricity in the rotating shaft of the photoconductor drum 40K so that variations may occur in the light irradiation to create crude density. Further, when the phase of the rotational speed variation differs for each photoconductor drum of each color, variations are created in the amount of positional deviations of the different colors to thereby result in color drift.

It is noted that eccentricity of the photoconductor drum 40K may be caused by a photoconductor drive gear (not shown) corresponding to a drive gear for the photoconductor drum 40K or a coupling element (not shown) for connecting the photoconductor drive gear and the photoconductor drum 40K.

With respect to the eccentricity component attributed to the photoconductor drive gear, since the photoconductor drive gears themselves are not exchangeable parts, measures may be taken to prevent positional deviations thereof upon manufacturing the tandem imaging apparatus by assembling the drive gears for the different color photoconductor drums in a manner such that their phases match. However, with respect to the eccentricity component attributed to the coupling element, since positional deviations of the coupling elements are caused by rotation of the coupling elements upon attaching/detaching the photoconductor drums, phase variations in the rotation of the photoconductor drums may inevitably be created. It is further noted the eccentricity of the photoconductor drum caused by detachment/attachment (maintenance) of the coupling member may have a greater influence on the rotation of the photoconductor drums compared to the eccentricity of the photoconductor drum caused by positional deviations of the photoconductor drive gear.

Thus, even when adjustments are made on the photoconductor drive gears to match the phases of the photoconductor drums 40K, 40C, 40M, and 40Y at the product manufacturing stage to minimize the occurrence of color drift, variations in the phases of the photoconductors drums may be easily created by exchanging the photoconductor drums thereafter so that color drift may not be effectively prevented.

Japanese Laid-Open Patent Publication No. 9-146329 discloses a technique for adjusting the rotational phase of photoconductor drums with respect to the color drift variable components occurring over the rotational period of the photoconductor drums. The disclosed technique involves adjusting the rotational phase of a photoconductor drum by forming color drift detection patterns on a transfer belt; detecting the patterns using CCD (charge coupled devices); extracting the maximum value, the minimum value, and the rise and fall zero cross points of a variation period (variation component) from the detected information; and averaging address values obtained from the four factors to detect a periodic rotational phase. In this way, influences of the rotation variations may be prevented from being reflected in the image being formed.

Also, Japanese Laid-Open Patent Publication No. 2003-145836 discloses a technique that involves forming an overlapping pattern of a combination of two colors, varying the rotational phases of corresponding photoconductor drums, and measuring the pattern width with a sensor. According to this technique, when the measured pattern width is a large value, this indicates that there are variations in the phase values of the photoconductor drums; on the other hand, when the measured pattern width is a small value, this indicates a match of the phase values. Thus, by repeating the process of varying the phases of the photoconductor drums and measuring the pattern width until the measured value of the pattern width becomes smaller than a threshold value, an optimal phase value may be detected.

However, according to the technique disclosed in Japanese Laid-Open Patent Publication No. 9-146329, the CCD is used as pattern detection means so that devices such as a timing generation circuit, a driver, and an amplifier circuit for amplifying the output signal of the CCD are required which leads to an increase in the price of the processing circuit.

Also, it is noted that the rotation variation value of the pattern formed on the transfer belt that is used as a reference for detecting the rotation variations of the photoconductor drums also represents rotation variations of other frequencies including rotation variations of a drive roller for driving the transfer belt and a roller supporting the transfer belt, for example. Therefore, in the case of detecting the phase and amplitude of a variation component based the zero cross points and peak values obtained from such a pattern, the resulting detection data may be significantly influenced by noise so that accuracy of the detection may not be ensured.

According to the technique disclosed in Japanese Laid-Open Patent Publication No. 2003-145836, a phase value that can reduce the occurrence of color drift to a certain degree is detected. However, since the detection is performed by sequentially varying the photoconductor drum phase, the phase varying amount per sequence has to be reduced in order to improve the accuracy of the detection in which case the detection process may take a long time. On the other hand, when the phase varying amount per sequence is increased, although the detection time may be reduced, the detection accuracy may be degraded and color drift generation may not be adequately prevented.

SUMMARY OF THE INVENTION

According to an aspect of the present invention, a technique is provided for accurately reducing positional deviation and color drift variation components generated in an imaging apparatus through inexpensive means.

According to an embodiment of the present invention, an imaging apparatus is provided that includes:

plural image carriers on which different-colored toner images are formed, the image carriers being driven and rotated to transfer the different-colored toner images onto one of an endless transfer member that is driven to rotate in contact with the image carriers or a transfer material that is carried by the endless transfer member;

a phase calculating unit that extracts a periodic rotational variation component of each of the image carriers from a combination of periodic rotational variation components generated within the imaging apparatus and calculates a rotational phase of each of the image carriers based on the extracted periodic rotational variation component; and a rotational phase adjusting unit that adjusts a rotation stop phase of each of the image carriers based on the calculated rotational phase.

According to an aspect of the present embodiment, periodic rotational variations caused by the image carriers may be detected from periodic rotational variations generated in the imaging apparatus, and rotational phases of the image carriers may be adjusted based on the detection.

In one preferred embodiment of the present invention, the phase calculating unit may divide the combination of periodic rotational variation components generated within the imaging apparatus into an in-phase component and a quadrature component of the rotational period of each of the image carriers and calculate the rotational phase of each of the image carriers based on the in-phase component and the quadrature component of the rotational period.

In another preferred embodiment of the present invention, the rotational phase adjusting unit may adjust the rotation stop phase of each of the image carriers using one of the image carriers as a reference.

In another preferred embodiment of the present invention, the rotational phase adjusting unit may use a rotational phase of one of the image carriers as a reference, obtain a difference between the rotational phase of said one of the image carriers and a rotational phase of another one of the image carriers, and adjust the rotation stop phase of each of the image carriers based on the obtained difference.

In another preferred embodiment, the imaging apparatus of the present invention may further include:

a detection pattern forming unit that forms a detection pattern on the endless transfer member;

a pattern detecting unit that detects the detection pattern formed by the detection pattern forming unit; and a detection time measuring unit that measures a detection time at which the detection pattern is detected by the pattern detecting unit; wherein the combination of periodic rotational variation components generated within said imaging apparatus corresponds to a plurality of the detection times measured by the detection time measuring unit; and the phase calculating unit extracts the periodic rotational variation component of each of the image carriers from the detection times measured by the detection time measuring unit and calculates the rotational phase of each of the image carriers.

In another preferred embodiment, the imaging apparatus of the present invention may further include:

a counter; wherein the detection time measured by the detection time measuring unit corresponds to a value indicated by the counter at either a rising edge timing or a falling edge timing of a pattern detection signal representing a detection status of the pattern detection unit.

In another preferred embodiment, the imaging apparatus of the present invention may further include:

a counter; wherein the detection time measured by the detection time measuring unit corresponds to a median value of a first value and a second value of the counter that are respectively indicated at a rising edge timing and a falling edge timing of a pattern detection signal representing a detection status of the pattern detection unit.

In another preferred embodiment, the imaging apparatus of the present invention may further include:

a marking arranged at each of the image carriers which marking indicates a rotating position of each of the image carriers; and a mark detecting unit that detects the marking of each of the image carriers; wherein the detection pattern forming unit starts forming the detection pattern based on a detection result of the mark detecting unit.

In another preferred embodiment of the present invention, the pattern forming unit may start forming the detection pattern when the mark detecting unit detects the marking.

In another preferred embodiment of the present invention, the rotational phase adjusting unit may adjust the rotation stop phase of each of the image carriers based on the rotational phase of each of the image carriers calculated by the phase calculating unit and the detection result of the mark detecting unit.

In another preferred embodiment of the present invention, the rotational phase adjusting unit may stop rotation of the image carriers after the mark detecting unit detects the marking of each of the image carriers, the image carriers being stopped according to the rotational phase of each of the image carriers calculated by the phase calculating unit.

In another preferred embodiment of the present invention, the detection pattern may correspond to plural toner patterns that are equidistantly arranged over a length equal to an integer multiple of a perimeter of the image carriers.

In another preferred embodiment of the present invention, the detection pattern may correspond to plural toner patterns that are equidistantly arranged over a length equal to a common multiple of a perimeter of the image carriers and another perimeter of another rotating element.

In another preferred embodiment of the present invention, the image carriers may be cylindrical rotating elements.

DESCRIPTION OF THE PREFERRED EMBODIMENTS

In the following, preferred embodiments of the present invention are described with reference to the accompanying drawings. It is noted that although a tandem printer that uses the intermediate transfer (indirect transfer) scheme is described below as an illustrative embodiment, the present invention is not limited to such an embodiment and may equally be applied to other types of imaging apparatuses. Also, it is noted that in the following descriptions the terms "image carrier" and "photoconductor drum" are used interchangeably.

(Overall Apparatus Configuration)

Figure 3:
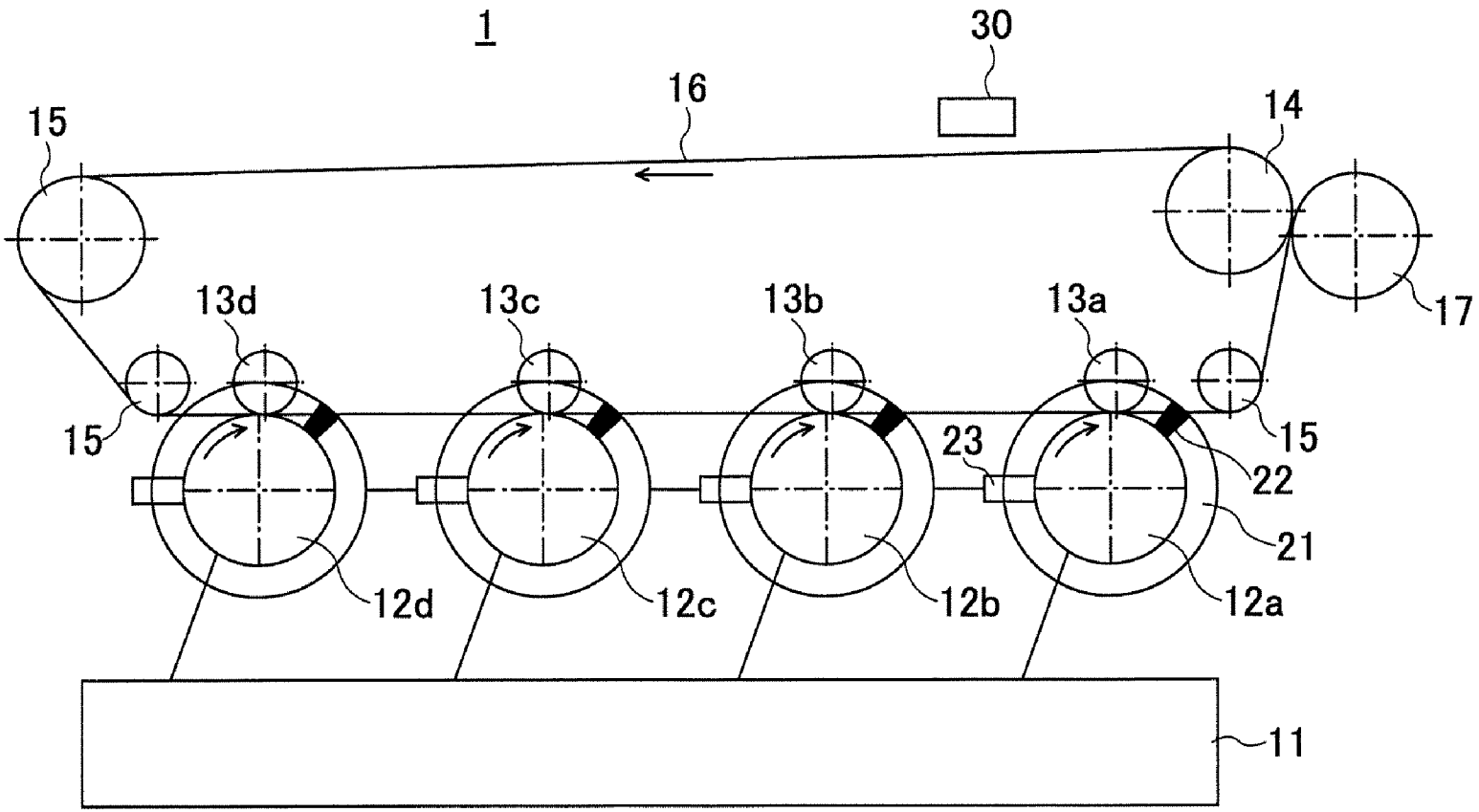
FIG. 3 is a diagram showing a configuration of a printer as an imaging apparatus according to an embodiment of the present invention.

FIG. 3 is a diagram showing a basic configuration of a printer as an imaging apparatus according to an embodiment of the present invention.

The illustrated printer 1 includes an exposure unit 11, a black image carrier 12*a*, a cyan image carrier 12*b*, a magenta image carrier 12*c*, a yellow image carrier 12*d*, bias rollers 13*a*, 13*b*, 13*c*, 13*d*, a drive roller 14, support rollers 15, an intermediate transfer belt 16, a secondary transfer roller 17, image carrier drive gears 21, image carrier position sensors 23, markings 22, and a pattern detecting unit 30, for example.

It is noted that in certain preferred embodiments, the illustrated printer 1 may include a paper feed table for accommodating a large stock of paper, a scanner, and/or an automatic document feeder in addition to the components described above.

The exposure unit 11 exposes light to develop single color toner images of black, cyan, magenta, and yellow on the surfaces of the black image carrier 12*a*, the cyan image carrier 12*b*, the magenta image carrier 12*c*, and the yellow image carrier 12*d*, respectively, based on black, cyan, magenta, and yellow color image information.

The black image carrier 12*a* is a drum element that supports the black toner image created by the exposure unit 11 and rotates in the clockwise direction. The black toner image on the black image carrier 12*a* is transferred onto the intermediate transfer belt 16. In one preferred embodiment, device elements such as a charger, a developer, and a cleaner (not shown) are arranged at the periphery of the black image carrier 12*a*. Also, the black image carrier 12*a* has elements such as the image carrier drive gear 21, the image carrier position sensor 23, and the marking 22 arranged at its side as is described below with reference to FIG. 4.

The cyan image carrier 12*b*, the magenta image carrier 12*c*, and the yellow image carrier 12*d* may have configurations similar to that of the black image carrier 12*a* described above.

The bias rollers 13*a*-13*d* are rotating elements that are used for transferring the toner images formed on the image carriers 12*a*-12*d* onto the surface of the intermediate transfer belt 20. In one specific embodiment, transfer voltages are applied to the bias rollers 13*a*-13*d* by a power supply unit (not shown) so that the toner images formed on the image carriers 12*a*-12*d* may be transferred onto the intermediate transfer belt 16.

The drive roller 14 is a rotating element that drives the intermediate transfer belt 16. The drive roller 14 is driven by a motor (not shown) to rotate at a predetermined rotational speed. In one preferred embodiment, the drive roller 14 may be in contact with the secondary transfer roller 17 to drive the secondary transfer roller 17 and act as sheet conveying means for conveying a sheet (not shown) having an image transferred thereon to a fixing unit (not shown) used for fixing the transferred image that is arranged at the upper side of the secondary transfer roller 17 in the arrangement shown in FIG. 3. In other embodiments, a transfer belt or a non-contact charger may be used as a secondary transfer unit.

The support roller 15 is a rotating element that supports the intermediate transfer belt 16.

The intermediate transfer belt 16 is an endless belt that acts as an intermediate transfer member for carrying the single color toner images formed on the image carriers 12*a*-12*d*. The single color toner images carried by the intermediate transfer belt 16 are then transferred onto a transfer sheet (not shown) that is inserted between the drive roller 14 and the secondary transfer roller 17 from the lower side of the arrangement shown in FIG. 3. The intermediate transfer belt 16 is arranged around four rotating elements, namely, the drive roller 14 and the support rollers 15, and is driven to move in the counterclockwise direction in FIG. 3. In one preferred embodiment, an intermediate transfer belt cleaner (not shown) for removing toner remaining on the intermediate transfer belt 16 after image transfer operations may be arranged at the left side of the support roller 15 that is positioned at the upper left hand side of the arrangement shown in FIG. 3.

The secondary transfer roller 17 is a rotating element that is used for transferring the toner image on the intermediate transfer belt 16 onto a recording medium such as a sheet (not shown). In one preferred embodiment, the secondary transfer belt 16 that is applied a transfer voltage by a power supply unit (not shown) may be used to transfer the image on the intermediate transfer belt 16 onto a sheet. In the illustrated example, the secondary transfer roller 17 and the drive roller 14 face each other and are arranged on opposite sides of the intermediate transfer belt 16.

The image carrier drive gear 21 arranged at each of the image carriers 12*a*-12*d* is configured to drive the corresponding image carrier 12*a*-12*d*. It is noted that the image carrier drive gear 21 for driving the black image carrier 12*a* is described below as a representative example.

The marking 22 is an indicator arranged at the image carrier drive gear 21. As is described in detail below, the marking 22 may be a predetermined mark or a flag, for example.

The image carrier position sensor 23 detects the marking 22 indicated on the image carrier drive gear 21. It is noted that the image carrier position sensor 23 arranged at each of the image carriers 12*a*-12*d* enables detection of the rotating direction position of the corresponding image carrier 12*a*-12*d*.

The pattern detecting unit 30 detects a toner pattern formed on the intermediate transfer belt 16, the details of which are described below with reference to FIG. 5.

(Apparatus Operations)

In the following, operations of the printer 1 shown in FIG. 3 are described. Specifically, exemplary operations are described below for reproducing a color document image on a printing sheet that is fed to the printer 1.

First, a document is placed on a document table of an automatic document feeder (ADF). Alternatively, the ADF may be opened so that the document may be placed on a contact glass of a scanner and the ADF may be closed thereafter to hold down the document. In the case where the document is placed on the document table, the document is conveyed through the ADF to be placed on the contact glass when a start switch (not shown) is pressed. On the other hand, in the case where the document is initially placed on the contact glass, the scanner is driven immediately in response to operation of the start switch. When the scanner is driven, light is irradiated from the light source at the same time, and light reflected from the document surface is reflected further to pass an image forming lens so that the document image may be read by an image read sensor. Alternatively, the printer 1 may acquire image information by receiving digital image information from an external source such as a personal computer or a digital camera.

In parallel with the document image reading operations or image information receiving operations described above, the drive roller 14 is driven and rotated by a drive source (not shown). In turn, the intermediate transfer belt 16 moves in the counterclockwise direction in FIG. 3, and the three support rollers 15 rotate in conjunction with the movement of the intermediate transfer belt 16. At the same time, the photoconductor drums 12*a*-12*d* as latent image carriers of individual image forming units are rotated, and light is exposed on the photoconductor drums 12*a*-12*d* based on black, cyan, magenta, and yellow color image information to develop single color toner images in black, cyan, magenta, and yellow on the photoconductor drums 12*a*-12*d*, respectively. Then, the toner images formed on the photoconductor drums 12*a*-12*d* are successively transferred onto the intermediate transfer belt 16 in a manner such that the toner images overlap one another, and in this way, a composite color image is formed on the intermediate transfer belt 16.

In parallel with the image forming operations as described above, a paper sheet is conveyed and inserted between the drive roller 14 and the secondary transfer roller 17 that make up a secondary transfer unit. In one embodiment, one of plural paper feed tables (not shown) may be selected, paper accommodated in one of plural paper feed cassettes arranged at a paper bank unit may be thrust forward, and paper may be fed to a paper feed path, one sheet at a time, by separating the sheets of paper by a separating roller, conveying and guiding the sheet through the paper feed path, and stopping the sheet with a resist roller. Then, the resist roller is rotated at an appropriate timing in accordance with the position of the composite color image formed on the intermediate transfer belt 16, and the sheet is conveyed between the intermediate transfer belt 16 and the secondary transfer roller 17 so that the composite color image may be transferred onto the sheet. Then, the sheet with the color image transferred thereon may be conveyed to a fixing unit (not shown) by the secondary transfer roller 17 with the conveying force of the opposing drive roller 14. Heat and pressure are applied to the transferred image by the fixing unit to fix the image after which the sheet is discharged by a discharge roller (not shown) to be stacked on a paper delivery tray (not shown).

(Configuration of Image Carrier Drive System Unit)

In the following, a configuration of a drive system unit arranged at the periphery of each of the image carriers 12*a*-12*d* of the printer 1 is described with reference to FIG. 4. It is noted that although FIG. 4 illustrates the configuration of the drive system unit arranged at the periphery of the black image carrier 12*a*, the drive system units for the cyan image carrier 12*b*, the magenta image carrier 12*c*, and the yellow image carrier 12*d* may also have similar configurations.

Figure 4:
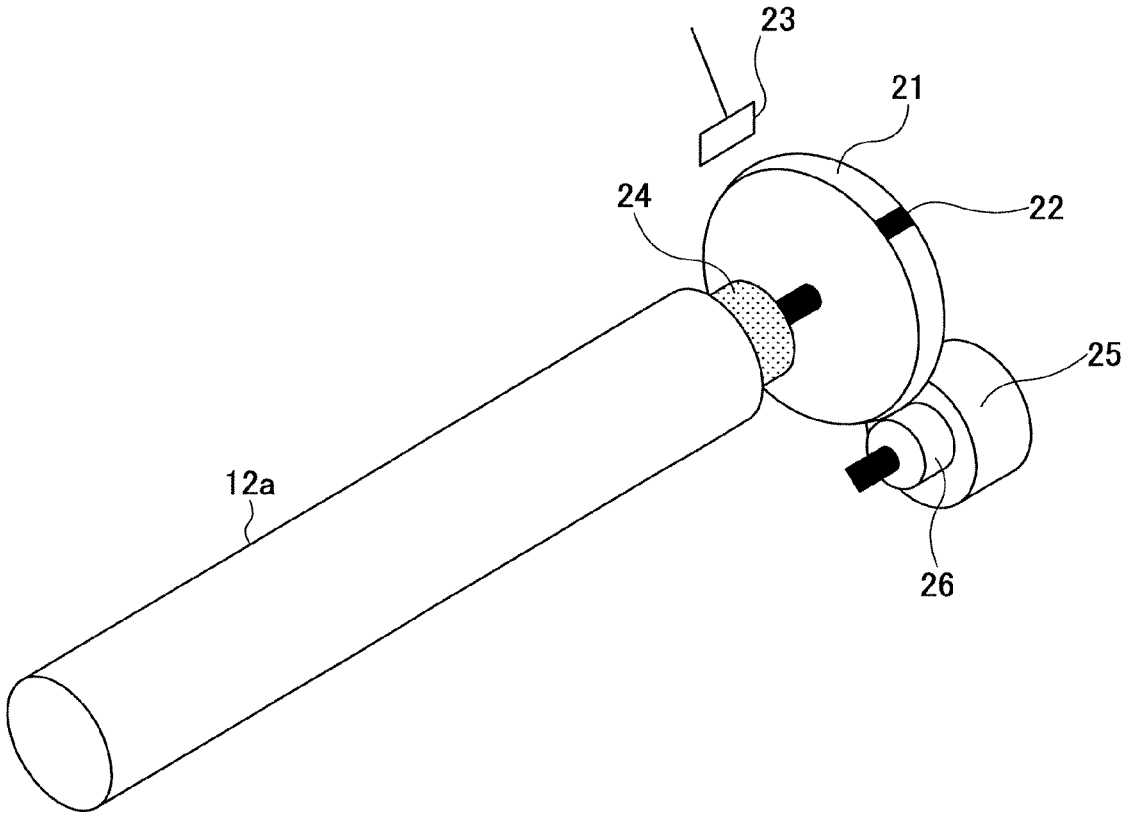
FIG. 4 is a diagram showing a configuration of a drive system unit arranged at an image carrier of the printer shown in FIG. 3.

As is shown in FIG. 4, the drive system unit arranged at the periphery of the black image carrier 12*a* of the printer 1 includes an image carrier drive gear 21, a marking 22, an image carrier position sensor 23, a coupling 24, a drive motor 25, and a motor shaft gear 26.

The image carrier drive gear 21 drives the black image carrier 12*a*, and conveys an output of the drive motor 25 to the black image carrier 12*a* via the coupling 24.

The marking 22 is a mark indicated on the image carrier drive gear 21.

The image carrier position sensor 23 detects the marking 22 indicated on the image carrier drive gear 21. The image carrier position sensor 23 is used to detect the position of the black image carrier 12*a* with respect to its rotating direction.

The coupling 24 is used for coupling the black image carrier 12*a* to the image carrier drive gear 21. In the illustrated example, the coupling 24 is arranged into a concave shape in order to facilitate engagement with the concave-shaped black image carrier 12*a*. It is noted that the black image carrier 12*a* usually does not last for the service life of the printer 1 so that it has to be occasionally exchanged as needed according to the degree of wear, and the coupling 24 may be used to facilitate such exchange operations.

The drive motor 25 drives the black image carrier 12*a* via the motor shaft gear 26, the image carrier drive gear 21, and the coupling 24. For example, the drive motor may be a DC servo motor corresponding to a DC brushless motor or a stepping motor.

The motor shaft gear 26 transmits a rotating force of the drive motor 25 to the image carrier drive gear 21. In the present example, the motor shaft gear 26 is arranged around a rotational shaft of the drive motor 25 and engages the image carrier drive gear 21.

The drive system unit having the above-described configuration rotates the black image carrier 12*a* with the rotating drive force of the drive motor 25 and detects the position of the black image carrier 12*a* with respect to its rotating direction using the marking 22 and the image carrier position sensor 23.

In one preferred embodiment, the rotational shaft of the black image carrier 12*a* may be supported by a main frame (not shown) of the printer 1 via a coupling.

(Configuration of Pattern Detecting Unit)

In the following, a configuration of the pattern detecting unit 30 of the printer 1 is described with reference to FIG. 5.

Figure 1:
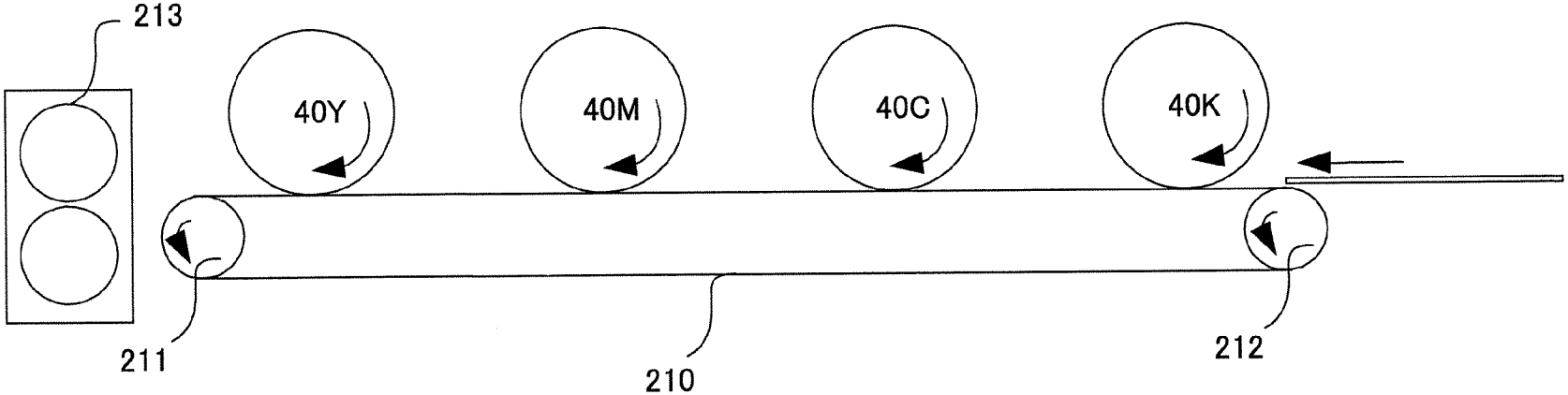
FIG. 1 is a diagram showing a configuration of a conventional tandem imaging apparatus.
Figure 2A:
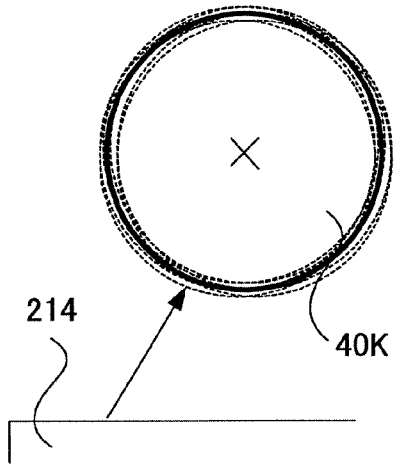
FIGS. 2A and 2B are diagrams illustrating rotational phase variations of a photoconductor drum of the tandem imaging apparatus shown in FIG. 1.
Figure 2B:
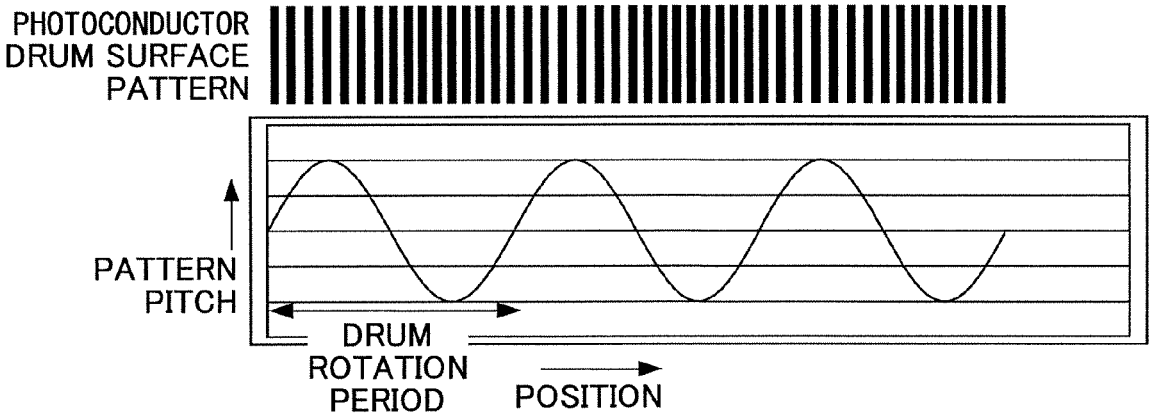
Figure 5:
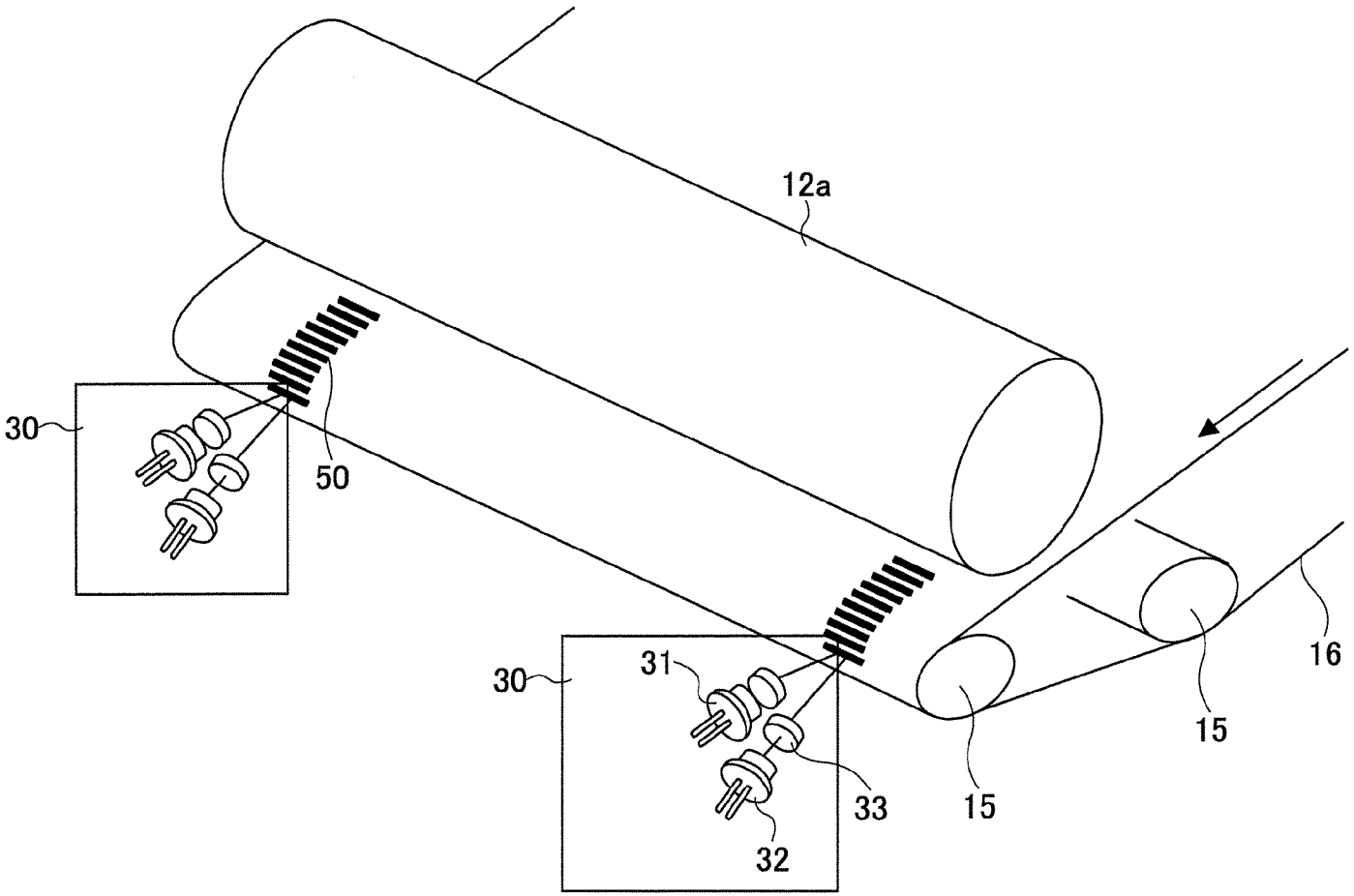
FIG. 5 is a diagram showing an exemplary configuration of a pattern detecting unit of the printer shown in FIG. 3.

FIG. 5 is a diagram showing a detailed configuration of the pattern detecting unit 30 of the printer 1 shown in FIG. 1. In the illustrated example, a pattern image 50 is formed on the intermediate transfer belt 16, and more than one pattern detecting units 30 are arranged along a perpendicular direction with respect to the belt moving direction (direction of arrow shown in FIG. 5) within an image region of the intermediate transfer belt 16.

In FIG. 5, the pattern detecting unit 30 includes a light emitting (LED) element 31, a light receiving element 32, and a condenser 33.

The LED element 31 is an illumination light source that has light energy for producing reflected light necessary for detecting the pattern image 50 formed on the intermediate transfer belt 16.

The light receiving element 32 receives light reflected by the pattern image 50 formed on the intermediate transfer belt 16 and passing through the condenser 33.

The condenser 33 is a lens that condenses the light reflected by the pattern image 50 formed on the intermediate transfer belt 16.

The pattern detecting unit 30 having the above-described configuration detects the pattern image 50 formed on the intermediate transfer belt 16.

(Configuration of Control Circuit)

In the following, a control circuit for controlling the printer 1 is described with reference to FIGS. 6 and 7.

Figure 6:
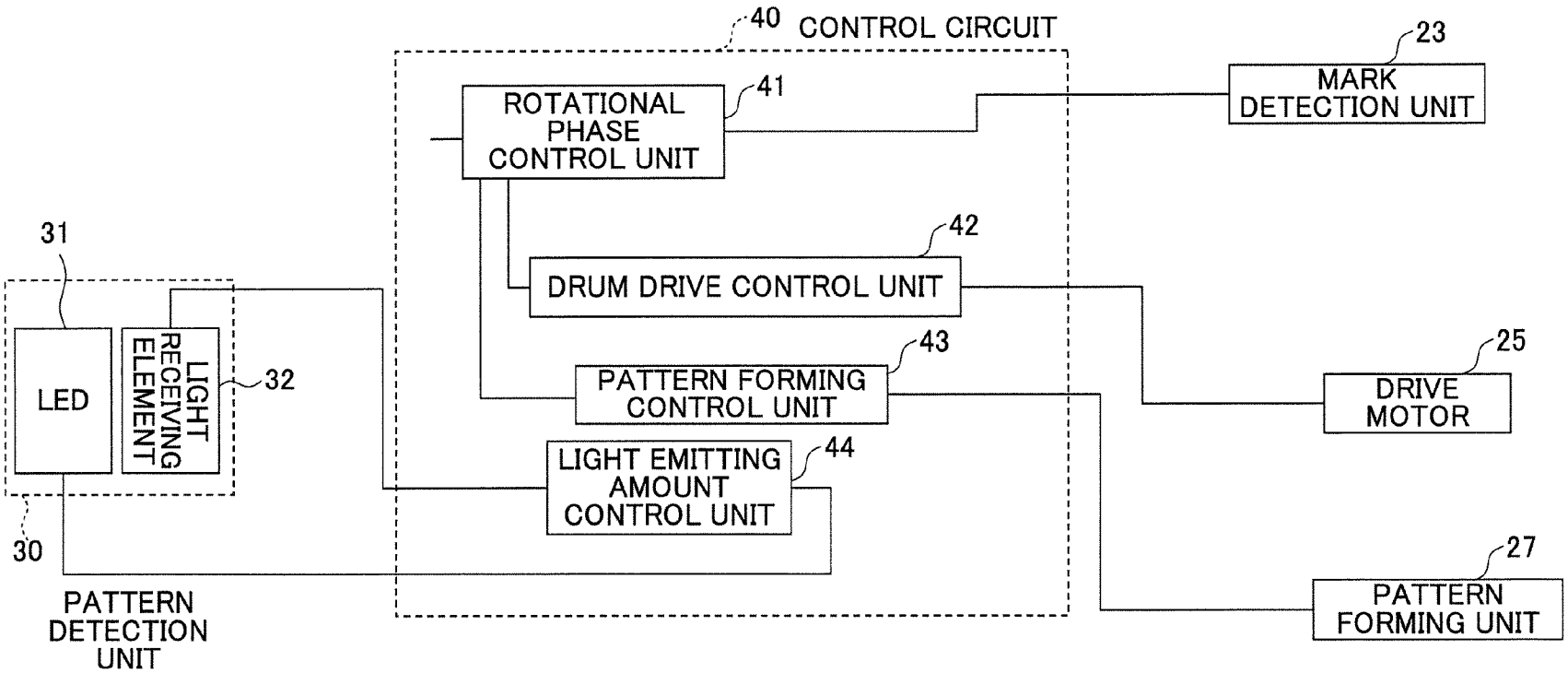
FIG. 6 is a block diagram showing a configuration of a control circuit that controls an imaging apparatus according to an embodiment of the present invention.

FIG. 6 is a block diagram showing an overall configuration of the control circuit.

The control circuit 40 shown in FIG. 6 includes a rotational phase control unit 41, a drum drive control unit 42, pattern forming control unit 43, and a light emitting amount control unit 44.

The rotational phase control unit 41 inputs a pattern image detection signal from the light receiving element 32 indicating detection of the pattern image 50, and controls the phases of the image carriers 12*a*-12*d* and the drum drive control unit 42 based on the input signal. The rotational phase control unit 41 also inputs a mark detection signal from the mark detecting unit (image carrier position sensor) 23 and controls the pattern forming control unit 43 based on the input signal.

The drum drive control unit 42 is controlled by the rotational phase control unit 41 and controls drive operations of the drive motor 25.

The pattern forming control unit 43 is controlled by the rotational phase control unit 41 and controls formation of pattern images on the image carriers 12*a*-12*d* performed by the exposure unit 11.

The light emitting amount control unit 44 controls the light emitting amount of the light emitter (LED) element 31.

Figure 7:
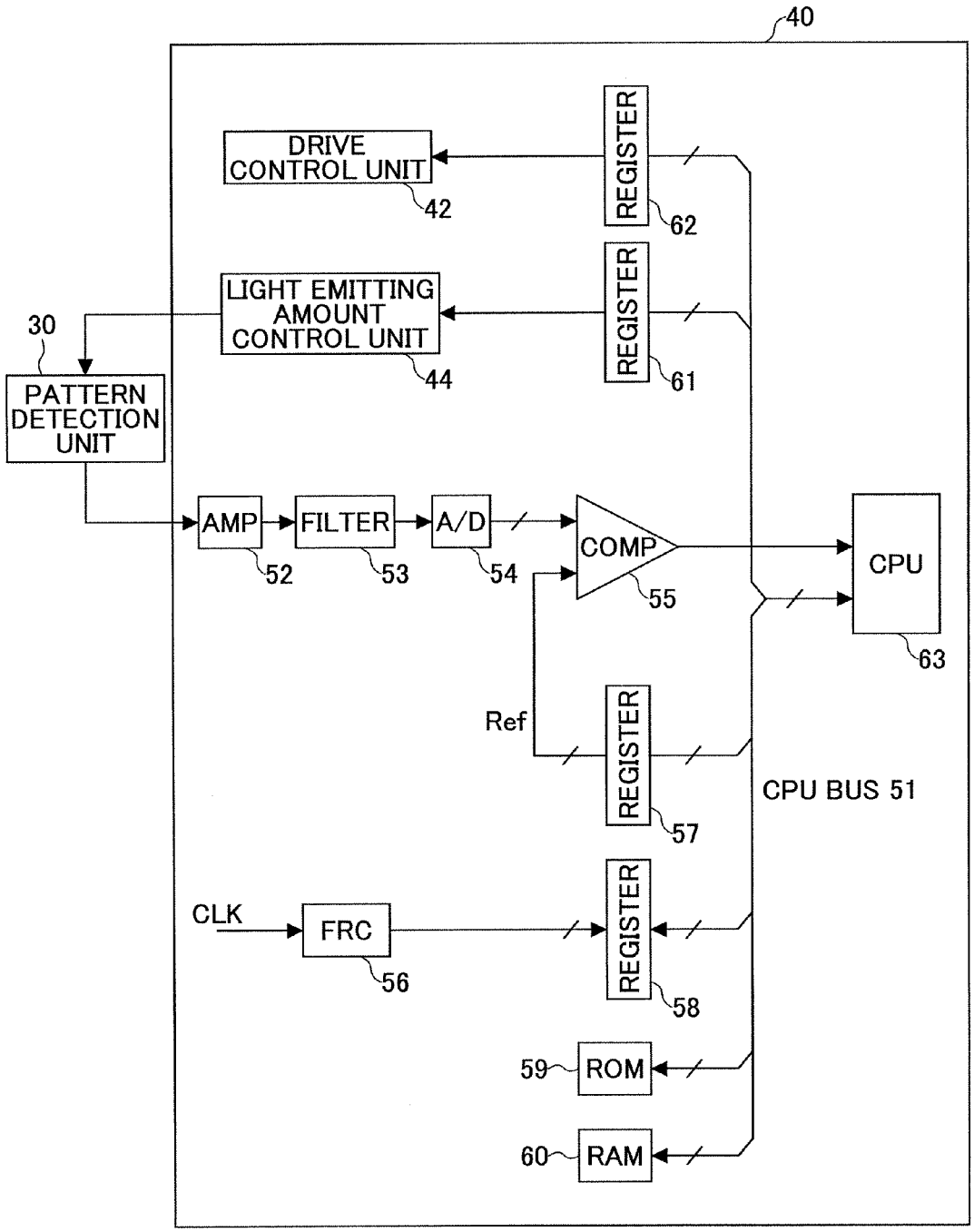
FIG. 7 is a block diagram showing an exemplary hardware configuration of the control circuit shown in FIG. 6.

FIG. 7 is a block diagram showing hardware components of the control unit 40 for controlling the printer 1.

In the illustrated example of FIG. 7, the control unit 40 includes a CPU bus 51, an AMP (amplifier) 52, a filter 53, an A/D converter 54, a COMP (comparator) 55, a FRC (Free Running Counter) 56, registers 57, 58, 61, and 62, a ROM 59, a RAM 60, and a CPU 63, for example.

The CPU bus 51 is an internal bus that interconnects the internal devices of the control circuit 40.

The AMP 52 amplifies a signal obtained from the pattern detecting unit 30 and transmits the amplified signal to the filter 53.

The filter 53 filters line detection signal components of the signal received from the AMP 52.

The A/D converter 54 converts the filtered signal received from the filter 53 from analog data to digital data.

The COMP 55 compares the signal level of the digitally converted signal received from the A/D converter 54 with a setting value of the CPU 63 that is stored in the register 57. If the signal level of the received signal is higher than the setting value of the CPU 63, the COMP 55 outputs a signal "H", and if the signal level is lower than the setting value, the COMP 55 outputs a signal "L". It is noted that when the signal level of the signal received from the A/D converter 54 changes from being higher to lower than the setting value of the CPU 63, the output signal of the COMP 55 changes from "H" to "L". On the other hand, when the signal level of the signal from the A/D converter 54 changes from being lower to higher than the setting value of the CPU 63, the output signal of the COMP 55 changes from "L" to "H", and in this case, the output signal of the COMP 55 may be an interruption input signal for the CPU 63.

The FRC 56 performs count operations over a predetermined time interval. The count value of the FRC 56 is stored in the register 58. The FRC 56 starts counting at an arbitrary timing right before pattern image read operations are started. It is noted that the frequency of the counter clock CLK is selectively determined based on the pattern reading speed, the number of patterns, and bit number of the counter, for example.

The register 57 stores the setting value of the CPU 63 that is used for comparison with the signal received from the A/D converter 54.

The register 58 stores the count value of the FRC 56. The stored count value of the FRC 56 may be lead to the CPU 63 via the CPU bus 51.

The register 59 stores data such as programs for computing the rotational phases of the image carriers 12*a*-12*d*, other types of programs, and apparatus-specific parameters related to image formation conditions such as the color drift amount. Also, the register 59 uses an address bus to designate a ROM address, a RAM address, and input/output devices.

The RAM 60 temporarily stores the programs and data stored in the ROM 59. For example, the RAM 60 may temporarily store the count value of the FRC 56 when the pattern image 50 is detected by the pattern detecting unit 30.

The CPU 63 executes processes according to programs stored in the RAM 60, for example. Also, upon inputting the interruption input signal of the COMP 55, the CPU 63 leads the count value of the FRC 56 stored in the register 58 to store the count value in the RAM 60. Further, the CPU 60 monitors the detection signal from the pattern detecting unit 30 at appropriate timings and controls the light emitting amount of the LED element 31 via the register and the light emitting amount control unit 44.

In the control unit 40 having the above-described configuration, when a signal is input from the pattern detecting unit 30, the count value of the FRC 56 is stored in the RAM 60. Then, the rotational phases of the image carriers 12*a*-12*d* are calculated based on the count value data stored in the RAM 60, and the rotational phases of the image carriers 12*a*-12*d* are adjusted by the drive control unit 42 based on the calculation results.

(Detection Pattern)

In the following, a configuration of detection patterns used for adjusting the rotational phases of the image carriers of the printer 1 is described.

Figure 8:
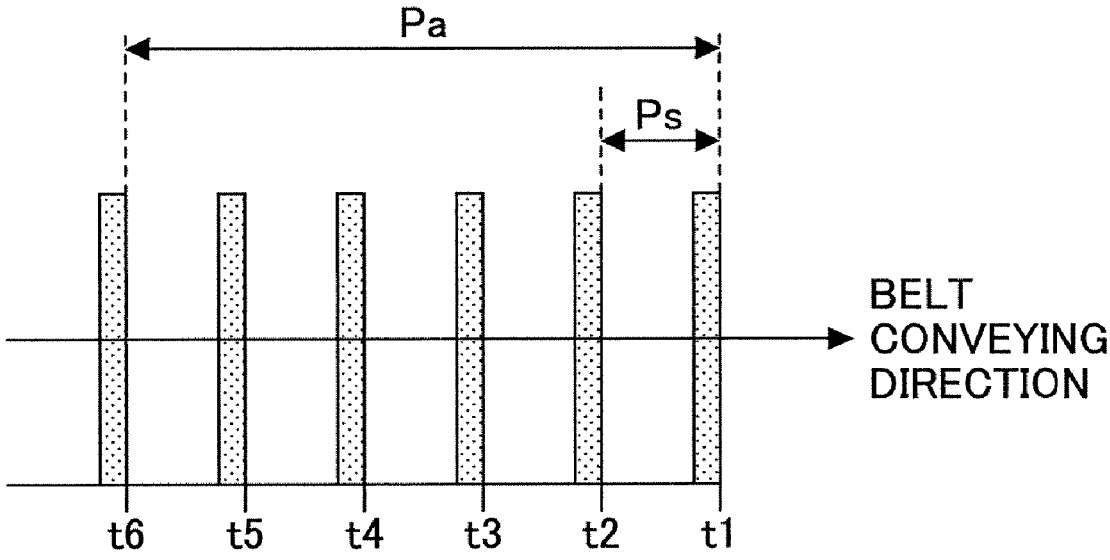
FIG. 8 is a diagram illustrating an exemplary group of detection patterns that may be used by an imaging apparatus according to an embodiment of the present invention.

FIG. 8 is a diagram illustrating a group of detection patterns. Specifically, FIG. 8 illustrates a group of toner image patterns (pattern group) that may be formed on the intermediate transfer belt 16 in one of the colors black, cyan, magenta, or yellow, for example. The patterns are arranged parallel to each other at a predetermined pitch Ps in a direction perpendicular to the conveying direction of the intermediate transfer belt 16. It is noted that in FIG. 8, Ps denotes a sampling pattern length.

In the following, the manner in which the sampling pattern length Pa and the pitch Ps are determined is described.

The sampling pattern length Pa is arranged to be a common multiple of the rotational period of the image carriers 12*a*-12*d* and the rotational period of some other rotating element of the printer 1. It is noted that periodic rotational variations occurring in the printer 1 are caused not only by the periodic rotational variations of the image carriers 12*a*-12*d* but by other frequency components including periodic rotational variations of other rotating elements such as the drive roller 14, pitch error or eccentricity components of the gear that transmits a drive force to the rotating elements, wobbling of the intermediate transfer belt 16, and hoop direction thickness deviations of the intermediate transfer belt 16, for example. By arranging the pattern length Pa to be a common multiple of the rotational variation periods of plural rotating elements as is described above, data superposing the corresponding frequency components may be obtained. In another embodiment, the sampling pattern length Pa may be set to an integer multiple of the rotational variation period of the image carriers 12*a*-12*d*.

The intervals between the patterns are preferably arranged to be equidistant, and the pitch Ps of the intervals is preferably narrow so that the patterns may be densely arranged to enable accurate detection. However, in practice, the pitch Ps is restricted by the pattern width requirements, computation time, and other various factors.

In the following, pattern detection operations are described.

Detection of the detection patterns formed on the intermediate transfer belt 16 by the pattern detecting unit 30 may be started at a given reference timing in accordance with the movement of the intermediate transfer belt 16. In FIG. 8, the detection times (from a given reference timing) at which the patterns formed on the intermediate transfer belt 16 are successively detected are denoted as t1, t2, t3, . . . , t6. In one preferred embodiment, detection patterns of the black image carrier 12*a* and detection patterns of another image carrier such as the cyan image carrier 12*b* may be formed on the left and right side edges of the intermediate transfer belt 16, respectively, so that variation components of two image carriers may be detected at the same time. Then, the above-described detection operations may be repeated for the other image carriers, namely, the magenta image carrier 12*c* and the yellow image carrier 12*d*. It is noted that the difference value between the detection value obtained for the black image carrier 12*a* and the detection value obtained for the cyan image carrier 12*b* may be used for correcting the rotational positions of the image carriers 12*a* and 12*b*, for example. In this way, relative deviations between black and cyan images may be reduced, for example.

As is described above, the positional deviation variation component may be detected with higher accuracy by reducing the pitch Ps of the patterns and densifying the patterns.

(Functional Configuration)

Figure 9:
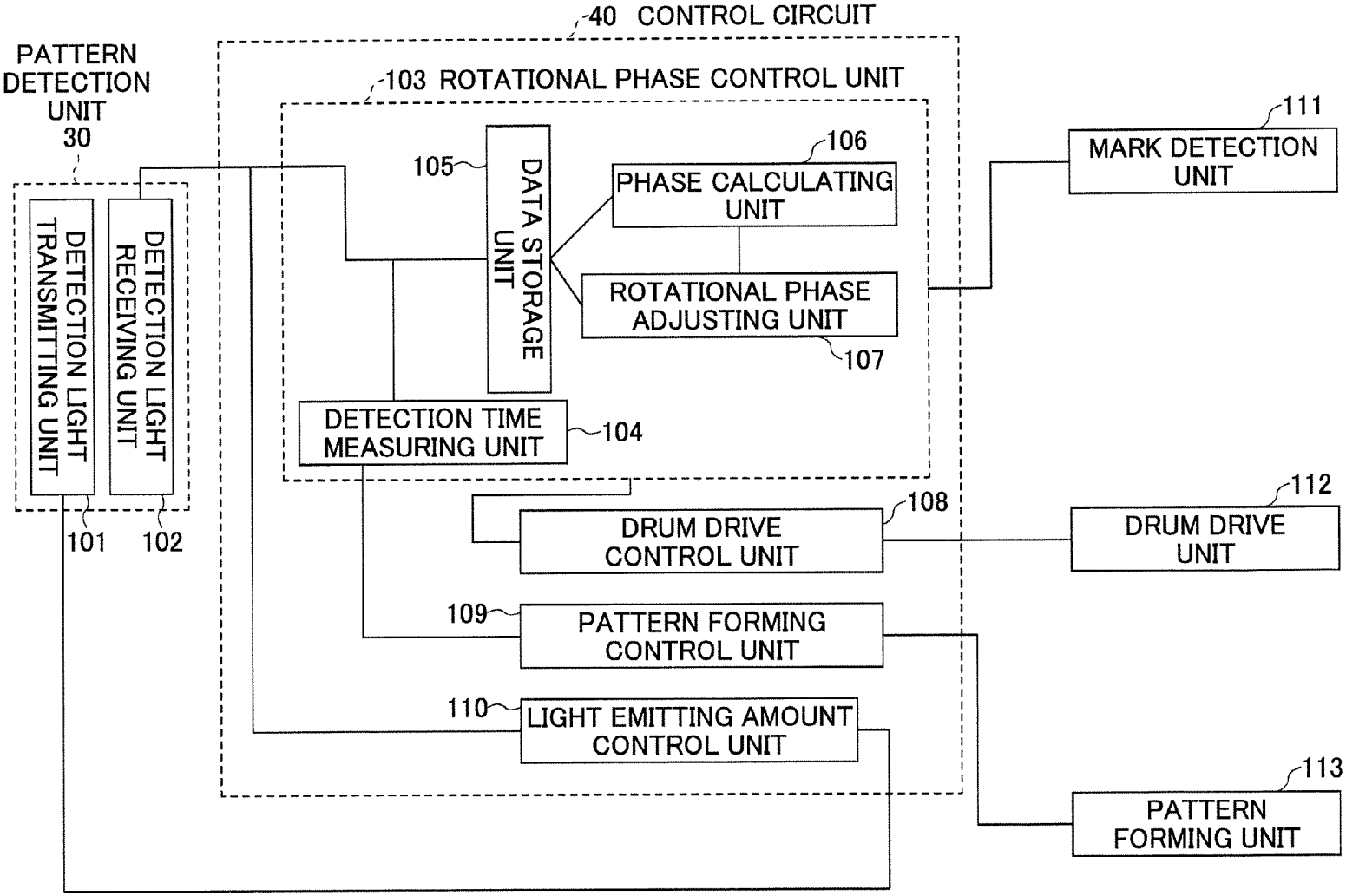
FIG. 9 is a block diagram showing an exemplary functional configuration of an imaging apparatus according to an embodiment of the present invention.

FIG. 9 is a block diagram illustrating a functional configuration of an imaging apparatus according to an embodiment of the present invention.

The illustrated imaging apparatus of FIG. 9 includes a pattern detecting unit 30, a control circuit 40, a mark detecting unit 111, a drum drive unit 112, and a pattern forming unit 113. The pattern detecting unit 30 includes a detection light transmitting unit 101 and a detection light receiving unit 102. The control circuit 40 includes a rotational phase control unit 103, a drum drive control unit 108, a pattern forming control unit 109, and a light emitting amount control unit. The rotational phase control unit 103 includes a detection time measuring unit 104, a data storage unit 105, a phase calculating unit 106, and a rotational phase adjusting unit 107.

The detection light transmitting unit 101 emits light for detecting a toner pattern formed on the intermediate transfer belt 16 and may be embodied by the LED element 31 shown in FIG. 5, for example. The light emitting amount of the light transmitting unit 101 is controlled by the light emitting amount control unit 110.

The detection light receiving unit 102 receives reflected light of the light irradiated on the intermediate transfer belt 16 by the detection light transmitting unit 101, and transmits a signal to the rotational phase control unit 103. For example, the detection light receiving unit 102 may be embodied by the light receiving element 32 shown in FIG. 5.

The rotational phase control unit 103 inputs the signal from the detection light receiving unit 102 and controls the rotational phases of the image carriers 12*a*-12*d* using the detection time measuring unit 104, the data storage unit 105, the phase calculating unit 106, and the rotational phase adjusting unit 107.

The detection time measuring means 104 measures the timing of the rising edge and falling edge of the signal received from the detection light receiving unit 102. For example, the FRC 56 of FIG. 7 may be used to implement the detection time measuring unit 104. It is noted that the time data obtained by the detection time measuring unit 104 are stored in the data storage unit 105.

The data storage unit 105 stores the time data obtained by the detection time measuring unit 104. For example, the data storage unit 105 may be embodied by the RAM 60 shown in FIG. 7.

The phase calculating unit 106 calculates the phases of the image carriers 12*a*-12*d* based on the time data stored in the data storage unit 105. It is noted that a specific manner in which the phases of an image carriers 12*a*-12*d* are calculated is described below.

The rotational phase adjusting unit 107 adjusts the phases of the image carriers 12*a*-12*d* based on the phase values of the image carriers 12*a*-12*d* calculated by the phase calculating unit 106.

The drum drive control unit 108 is controlled by the rotational phase control unit 103 and controls the drum drive unit 112. In one embodiment, the drum drive control unit 108 and the rotational phase adjusting unit 107 may correspond to a common function.

The pattern forming control unit 109 is controlled by the rotational phase control unit 103 and controls the pattern forming unit 113.

The light emitting amount control unit 110 controls the detection light transmitting unit 101 based on a light reception signal received from the detection light receiving unit 102. For example, the light emitting amount control unit 110 may control the amount of light emitted by the detection light transmitting unit 101 so that the light reception signal received from the detection light receiving unit 102 may be maintained at a fixed level.

The mark detecting unit 111 detects a mark indicating the rotational position a corresponding image carrier of the image carriers 12*a*-12*d*. For example, the mark detecting unit 111 may be embodied by the image carrier position sensor 23 that detects the marking 22 shown in FIG. 4.

The drum drive unit 112 drives and rotates the image carriers 12*a*-12*d*. For example, the drum drive unit 112 may be embodied by the drive motor 25 shown in FIG. 4.

The pattern forming unit 113 forms rotational variation detection patterns on the image carriers 12*a*-12*d*. For example, the pattern forming unit 113 may be embodied by the exposure unit 11 shown in FIG. 3.

In an imaging apparatus having the above-described functional configuration, the rotational phases of the image carriers 12*a*-12*d* may be controlled by the phase calculating unit 106 and the rotational phase adjusting unit 107.

(Phase Calculation Method)

In the following, an embodiment of the phase calculating unit 106 is described with reference to FIG. 10.

Figure 10:
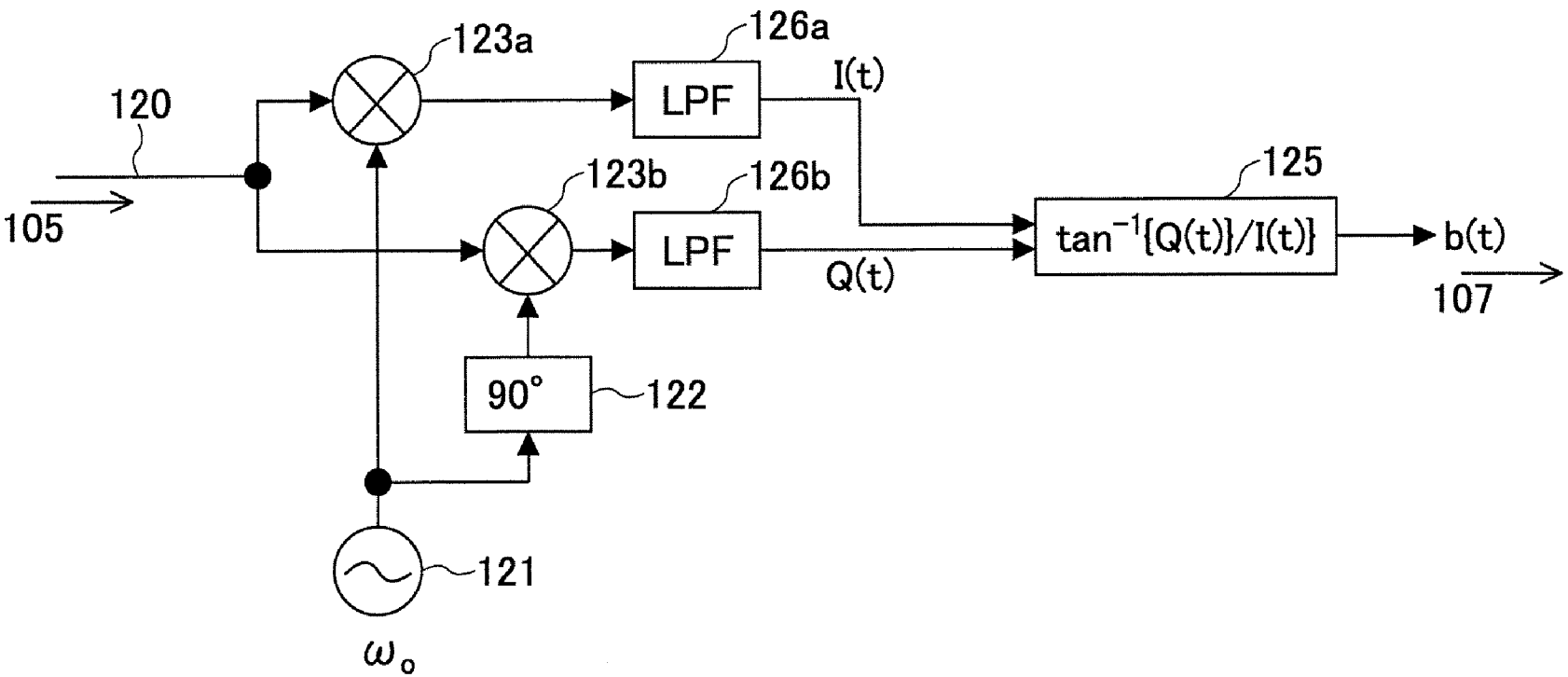
FIG. 10 is a diagram showing an exemplary configuration of a phase calculating circuit as an embodiment of a phase calculating unit of the imaging apparatus shown in FIG. 9.

FIG. 10 is a diagram illustrating an exemplary rotational phase calculating circuit used for calculating the rotational phase of the black image carrier 12*a* of the printer 1. In the illustrated example, the phase calculating circuit may be configured to extract the phase of data corresponding to the frequency component of the black image carrier 12*a* from data having plural frequency components that are stored in the data storage unit 105.

In FIG. 10, data stored in the data storage unit 105 are input to the phase calculating circuit to be used as an input signal 120. In the illustrated phase calculating circuit, an oscillator 121 outputs a signal corresponding to the frequency component that is subject to detection (oscillation frequency signal) to a multiplier 123*a* and a ninety-degree phase shifter 122. For example, the oscillator 121 is oscillated at a frequency corresponding to the rotational frequency ωo of the black image carrier 12*a* and at a phase based on a given reference timing that is used upon forming detection patterns. It is noted that the rotational frequency ωo of the black image carrier 12*a* may be accurately obtained by measuring the intervals of detection signals detecting the marking 22 on the image carrier drive gear 21. The multiplier 123*a* multiplies the input signal 120 by the oscillation frequency signal output by the oscillator 121 and outputs a signal corresponding to the in-phase component (I component) of the input signal 120 and the rotational frequency ωo of the black image carrier 12*a*. The ninety-degree phase shifter 122 shifts the phase of the oscillation frequency signal from the oscillator 121 and outputs the phase-shifted signal to a multiplier 123*b*. The multiplier 123*b* multiplies the input signal 120 by the signal output by the ninety-degree phase shifter 122 and outputs a signal corresponding to a quadrature component (Q component) of the input signal 120 and the rotational frequency ωo of the black image carrier 12*a*. The output signals of the multipliers 123*a* and 123*b* are passed through low-pass filters (LPF) 126*a* and 126*b*, respectively. For example, the LPF 126*a* passes only low frequency band components of the output signal of the multiplier 123*a*. In the illustrated embodiment, the LPF 126*a* is designed to smooth out data extending over a period equal to an integer multiple of the period of the frequency ωo; namely, data having a length equal to the sampling pattern length Pa. It is noted that the LPF 126*b* may be designed in a similar manner. By smoothing the data over the sampling pattern length Pa, the drive roller rotational period component as one of potential error-causing components may be canceled and set to "0" by the smoothing process. Then, a phase computing unit 125 calculates phase b(t) corresponding to the phase angle with respect to a given reference timing of the periodic rotational variation of the black image carrier 12*a*.

As can be appreciated from the above descriptions, the phase calculating unit 106 extracts the phase of data corresponding to the frequency component of the black image carrier 12*a* from data having plural frequency components that are stored in the data storage unit 105 and transmits the extracted phase to the rotational phase adjusting unit 107.

(Rotational Phase Adjustment)

In the following, an exemplary method for adjusting the rotational phases of image carriers 12*a*-12*d* of the printer 1 is described with reference to FIGS. 11-17.

Figure 11:
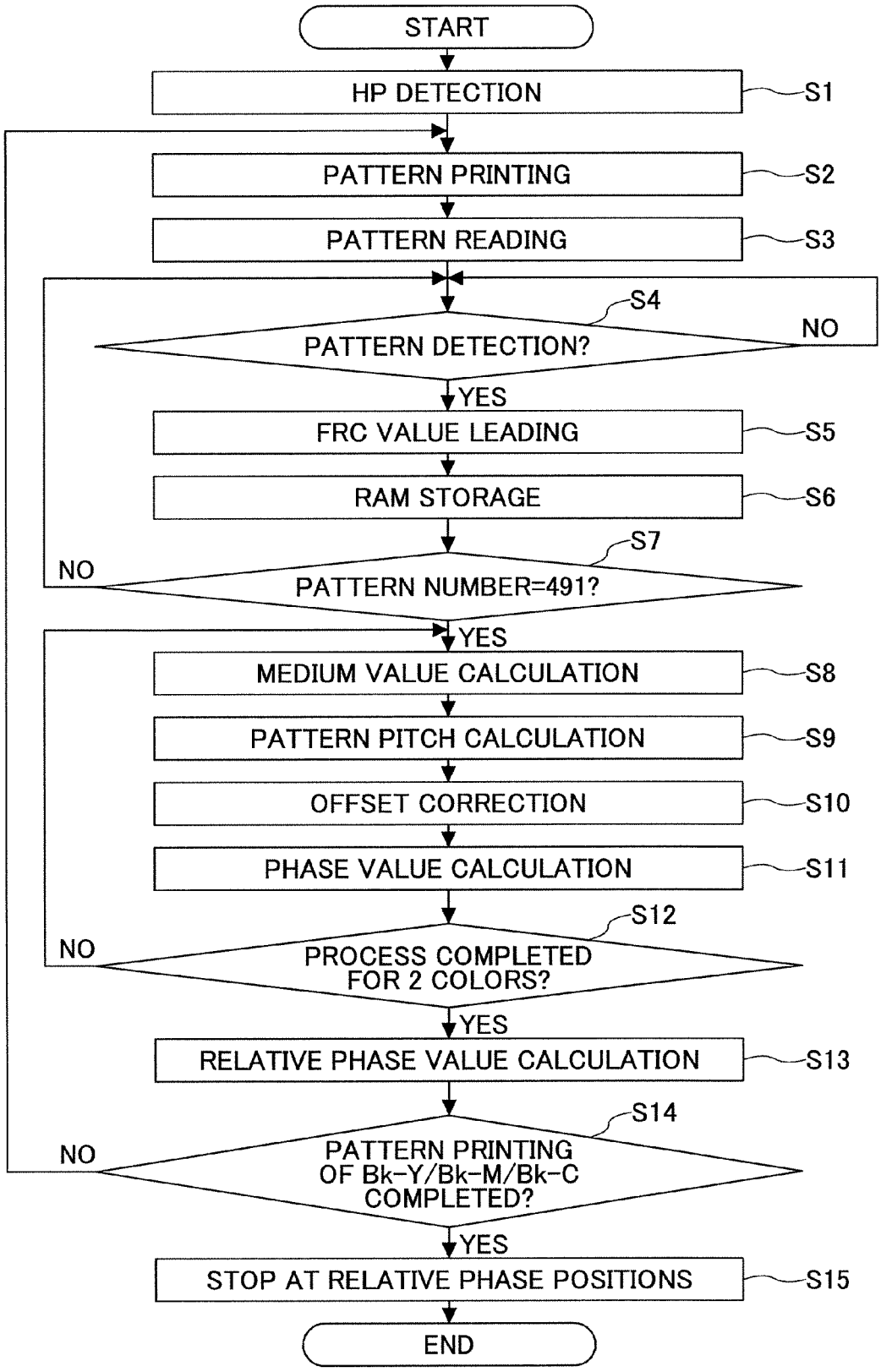
FIG. 11 is a flowchart illustrating adjustment operations performed at an imaging apparatus according to an embodiment of the present invention.

FIG. 11 is a flowchart illustrating an exemplary process for adjusting the rotational phases of the image carriers 12*a*-12*d*. Specifically, this drawing illustrates a sequence of process steps performed from the time the image carriers 12*a*-12*d* are exchanged in the printer 1 until the rotational phases of the exchanged image carriers 12*a*-12*d* are adjusted.

The rotational phase adjustment process for adjusting the rotational phases of the image carriers 12*a*-12*d* may be started by a serviceperson, for example.

Figure 12:
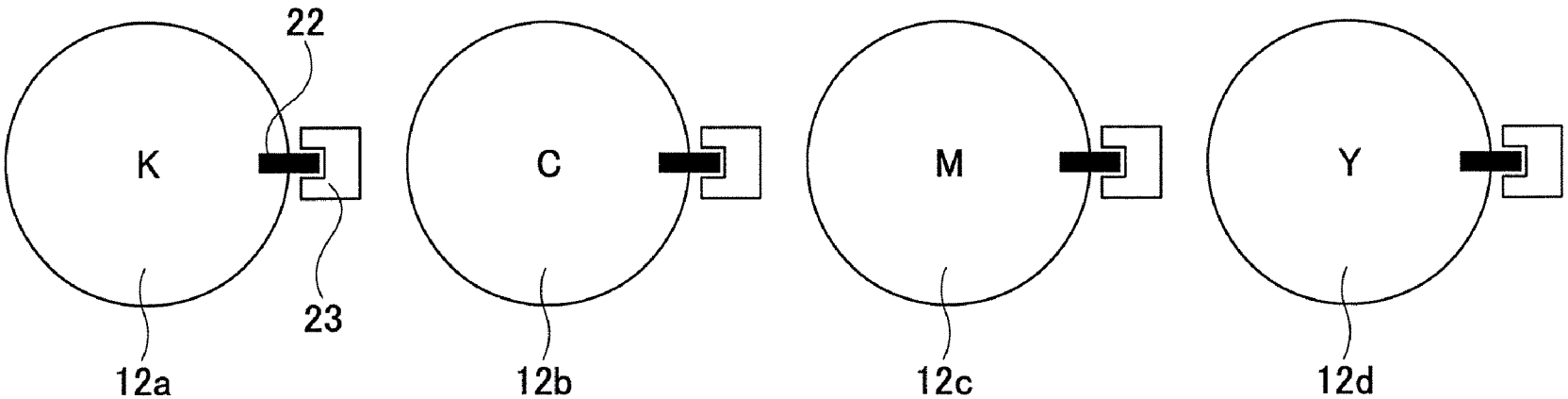
FIG. 12 is a diagram illustrating initial positions of image carriers.

When the rotational phase adjustment process is started, the initial phases of the image carriers 12*a*-12*d* are set to 0° as is shown in FIG. 12 (home position detection step S1). Specifically, the markings 22 are positioned at the corresponding detection points of the image carrier positions sensors 23 within the image carriers 12*a*-12*d*.

In the home position (HP) detection step S1, the drum drive control unit 108 starts rotation of the image carriers 12*a*-12*d*, and the mark detecting unit 111 detects the markings 22 of the image carriers 12*a*-12*d*. When the markings 22 are detected, the drum drive control unit 108 stops the rotation of the image carriers 12*a*-12*d*.

Then, rotational variation detection patterns of the black image carrier 12*a* and magenta image carrier 12*c*, each made up of 491 strips of patterns, for example, are formed on the intermediate transfer belt 16 (pattern printing step S2).

For example, the configuration of detection patterns shown in FIG. 8 may be used to form the rotational variation detection patterns. In the following, an exemplary manner of determining the pattern length Pa, the pattern pitch Ps, and the number of patterns (i.e., 491 in the present example) is described. In the present example, an encoder (not shown) is attached to the roller shaft of the support roller 15 positioned at the lower right hand side in FIG. 3, and feedback control is performed to enable uniform rotation of the encoder. Therefore, rotational period variations of the image carriers 12*a*-12*d* and rotational period variations of the support roller 15 are relatively large factors causing periodic rotational variations in the printer 1.

In the present example, the diameter of the image carriers 12*a*-12*d* is 40 mm, the diameter of the support roller 15 is 17.5 mm, and thereby, the pattern length Pa is arranged to be 1760 mm, which is a common multiple of the diameters of the image carriers 12*a*-12*d* and the support roller 15. In this case, the image carriers 12*a*-12*d* may rotate 14 rounds, and the support roller 15 may rotate 32 rounds over the pattern length Pa. The pattern pitch Ps may be set to 3.598 mm in consideration of the light receiving spot diameter of the pattern detecting unit 30 so that in a case where the printing resolution in the sub scanning direction is 600 DPI, the pattern pitch Ps may extend over a distance of 85 dots. Accordingly, 1760 mm/3.598 mm≈490 may be obtained as the number of patterns. It is assumed that the detection patterns used for data processing in the present example is made up of 491 patterns.

In the pattern printing step S2, the drum drive unit 108 starts rotation of the black image carrier 12*a* and the magenta image carrier 12*c*, and the exposure unit 11 forms a rotational variation detection pattern image including 491 patterns on each of the image carriers 12*a* and 12*c*, the detection pattern image having a pattern length of 1760 mm and a pattern pitch of 3.598 mm. The detection pattern images formed on the image carriers 12*a* and 12*c* are then transferred onto the intermediate transfer belt 16.

Then, the pattern detecting unit 30 that has undergone light emitting amount adjustment operations starts reading the patterns formed on the intermediate transfer belt 16, and at the same time, the FCR 56 starts counting operations (step S3).

Figure 13:
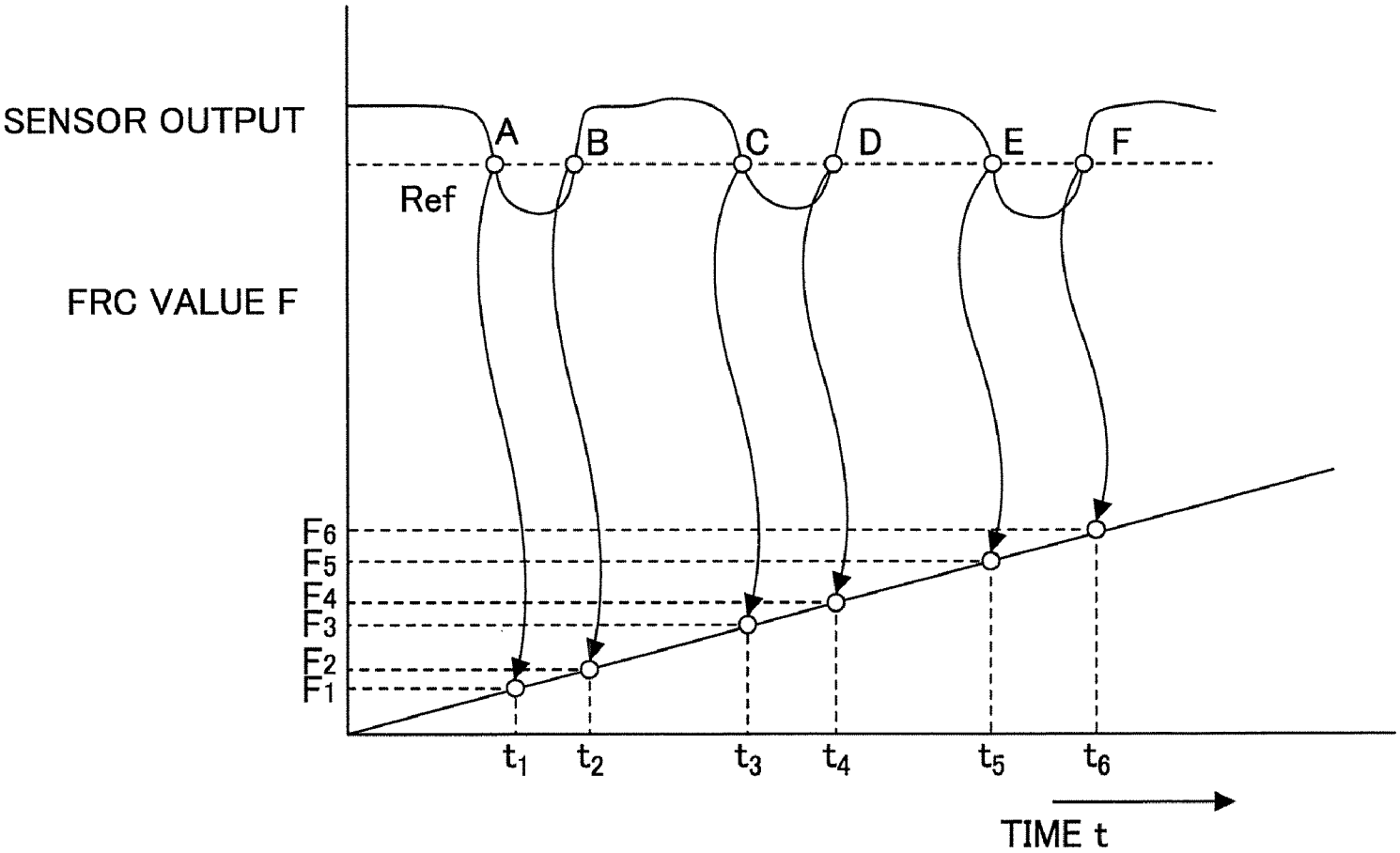
FIG. 13 is a graph illustrating a correspondence between sensor outputs and FRC values in relation to time.

FIG. 13 is a graph illustrating the sensor output of the pattern detecting unit 30 and the count value of the FRC 56 in relation to time.

In step S3, the light emitting amount adjusting unit 110 adjusts the light emitting amount of the LED element 31, and in turn, the LED element 31 starts irradiating light on the intermediate transfer belt 16. The light receiving element 32 receives light reflected by the intermediate transfer belt 16 and outputs a signal to the AMP 52 of the control circuit 40. In this way, pattern reading operations may be started. It is noted that the signal output by the light receiving element 32 is amplified by the AMP 52, and is then passed onto the filter 53 and the A/D 54 to reach the COMP 55. Also, the FRC 56 of the control circuit 40 starts counting operations and stores count values in the register 58.

In step S4, a determination is made as to whether an interruption signal indicating detection of a rising edge or a falling edge has been input to the CPU 63. In other words, a determination is made as to whether the pattern detecting unit 30 has detected a pattern edge.

When an interruption signal is input (step S4, YES), the CPU 63 leads a corresponding count value of the FRC 56 from the register 58 (step S5).

For example, referring to FIG. 13, when interruption signals are input at timings represented by points A, B, C, D, E, and F, the CPU 63 leads corresponding count values F1, F2, F3, F4, F5, and F6 of the FRC 56.

Figure 14:
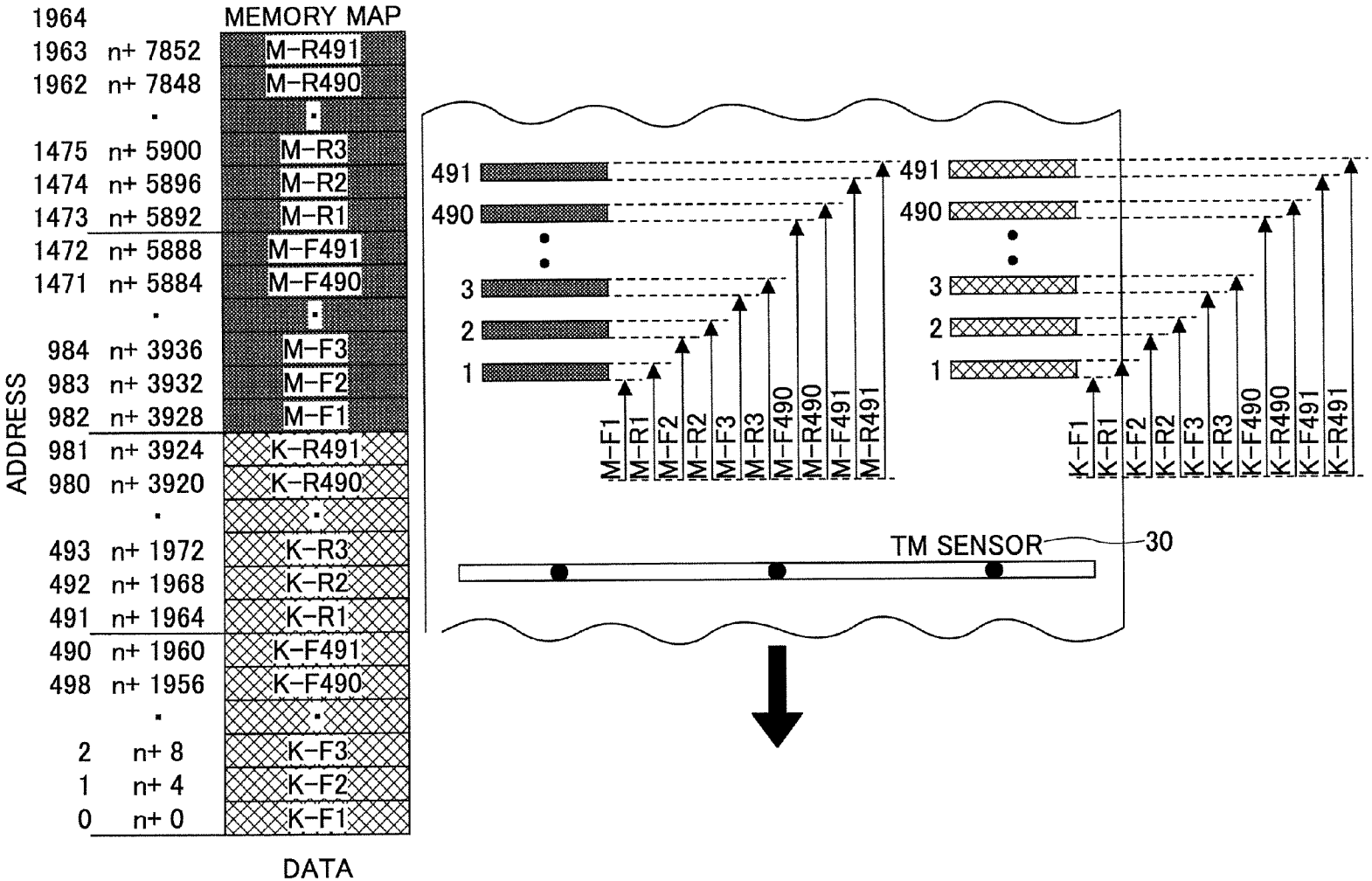
FIG. 14 is a diagram illustrating data stored in a RAM as a result of leading FRC values.

The value led by the CPU 63 is stored in the RAM 60 (step S6). FIG. 14 is a diagram illustrating data stored in the RAM 60 in step S6. In FIG. 14, the corresponding FRC values upon detecting pattern edges of the detection pattern formed by the black image carrier 12*a* are identified as K-F1, K-R1, K-F2, and so on. The corresponding FRC values upon detecting patterns strip edges of the detection pattern formed by the magenta image carrier 12*c* are identified as M-F1, M-R1, M-F2, and so on.

In step S7, the CPU 63 determines whether 491 patterns have been detected.

When it is determined that 491 patterns have been detected in the pattern reading operations (step S7, YES), the process moves onto step S8. On the other hand, when it is determined that the number of patterns detected in the pattern reading operations does not amount to 491 (step S7, NO), the process goes back to step S4 to continue the pattern reading operations.

In step S8, with respect to data pertaining to the black image carrier 12*a* that are stored in the RAM 60*a*, a median value is calculated based on the rising edge and falling edge detection data.

Figure 15A:
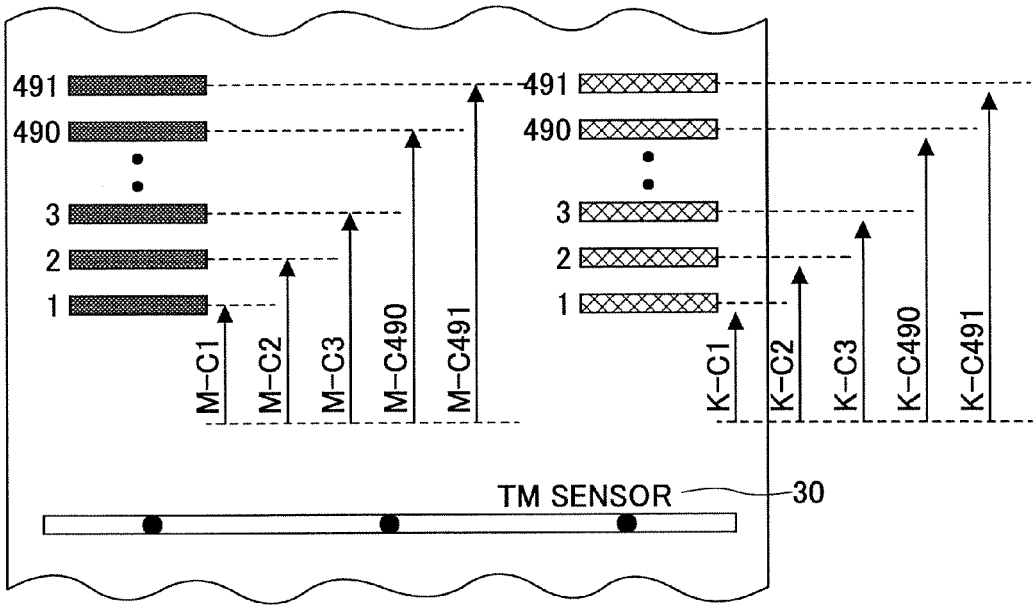
FIG. 15A is a diagram illustrating median value data.
Figure 15B:
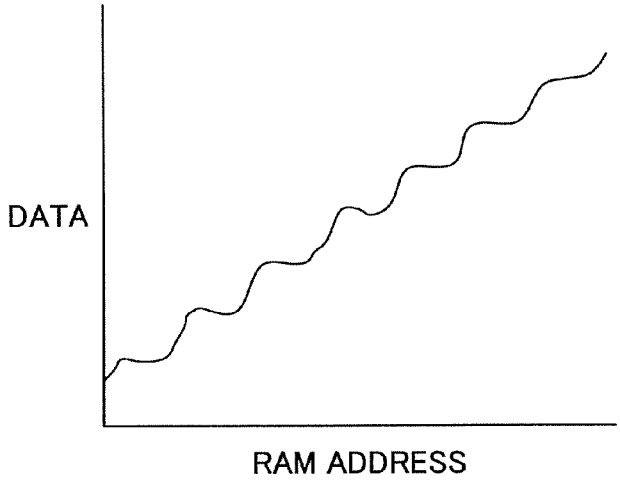
FIG. 15B is a graph illustrating a relationship between a RAM address and the median data shown in FIG. 15A.

Specifically, in step S8, a process is performed for correcting determination value errors that have occurred in step S4 where sensor outputs that may have varying amplitude levels and offset levels are compared with a fixed threshold value corresponding to the setting value of the CPU 63. FIG. 15A is a diagram illustrating the median value data obtained in step S8. FIG. 15B is a graph illustrating a relationship between the RAM address and the median value data. Specifically, the relationship between the RAM address and the median value data is illustrated as a line graph that slopes upward from left to right in FIG. 15B, where the horizontal axis represents the address of the RAM 60 and the vertical axis represents the median value. It is noted that in FIG. 15B, sine curve correction is performed on a discrete data group representing the relationship between the address of the RAM 60 and the median value data.

Figure 16A:
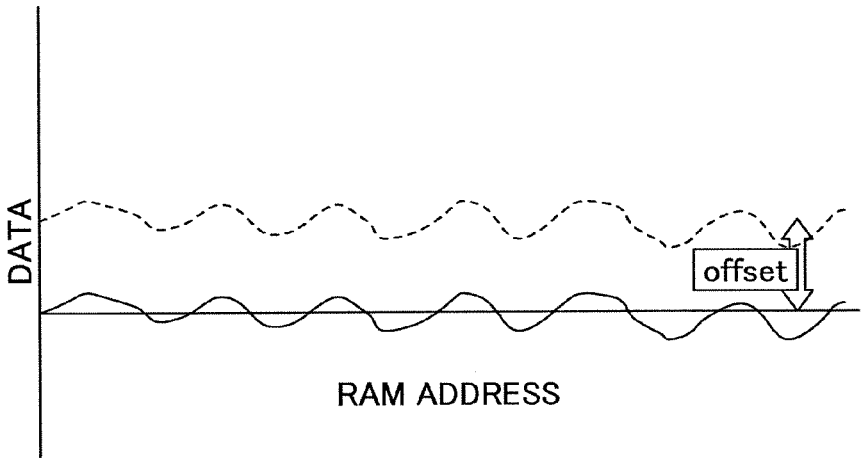
FIGS. 16A and 16B are graphs illustrating a relationship between a RAM address and offset-corrected data.
Figure 16B:
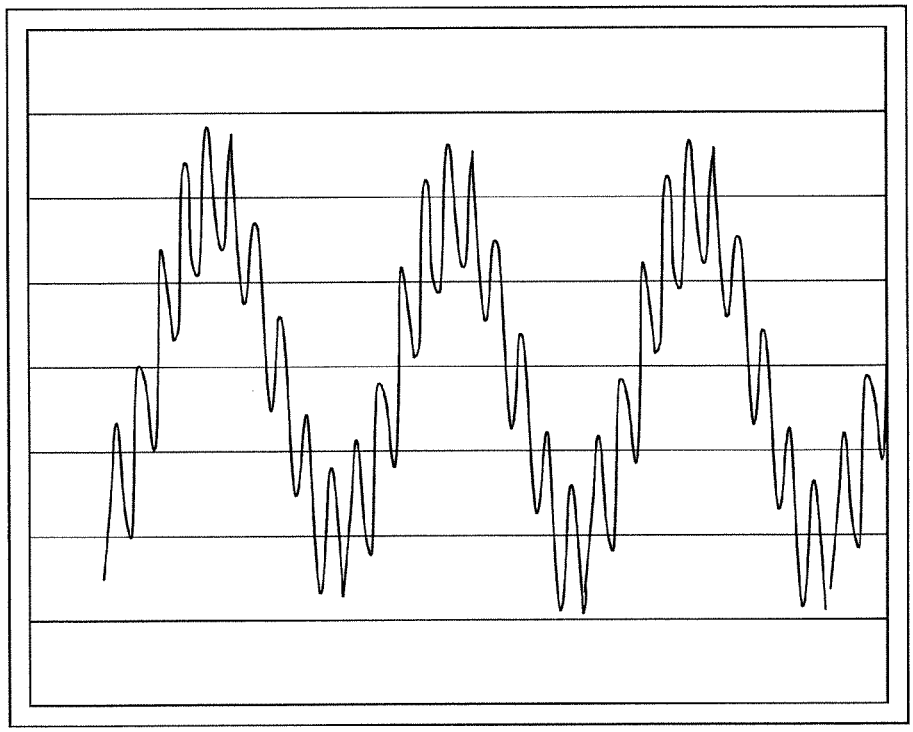

Then, the distance between adjacent patterns is calculated (pitch calculation step S9), and offset correction is performed (step S10). FIG. 16A is a graph illustrating the relationship between the RMA address and data upon performing the correction process of step S10. As is shown in FIG. 16A, in step S10, the rotational variation component of the black image carrier 12*a* when the average value of all the data is set to "0" may be extracted. It is noted that in practice, the data extracted in step S10 may be in the form of a composite wave as is illustrated in FIG. 16B that has rotational variation components of other rotating elements involved in image formation superposed on the data of FIG. 16A.

Then, the phase calculating unit 106 extracts a component corresponding to one rotation of the black image carrier 12*a* from the data extracted in step S10 and calculates a phase value (step S11).

For example, the phase calculation circuit shown in FIG. 10 may be used to perform the phase calculation step S11. Specifically, the oscillator 112 of the phase calculating circuit may oscillate at the rotation frequency ωo of the black image carrier 12*a*. In the present example, it is assumed that the input signal 120 input to the phase calculating circuit corresponds to the rotational variation component data extracted in step S10. Also, in the present example, it is assumed that the phase calculating circuit calculates the rotational phase of the black image carrier 12*a* as 0°.

Then, in step S12, a determination is made as to whether the above-described calculation processes have been completed for the image carriers of the two colors subject to detection operations (i.e., the black image carrier 12*a* and the magenta image carrier 12*c* in the present example).

If the calculation processes are completed for the image carriers of the two colors (step S12, YES), the process moves on to step S13. If the calculation processes are not completed for the image carriers of the two colors (step S12, NO), the process goes back to step S8.

In the present example, since the calculation processes are not yet completed for the magenta image carrier 12*c*, the process goes back to step S8 so that the processes of steps S8 through S11 may be performed with respect to the data pertaining to the magenta image carrier 12*c* that are stored in the RAM 60 to calculate the rotational phase of the magenta image carrier 12*c*. In the present example, it is assumed that the rotational phase of the magenta image carrier 12*c* is 300°. It is noted that in calculating the rotational phase of the magenta image carrier 12*c* in step S11, the oscillator 121 of the phase calculation circuit is oscillated at the same rotational frequency (i.e., ωo) and phase as that used for calculating the rotational phase of the black image carrier 12*a*.

In step S13, the rotational phase adjusting unit 107 a relative phase value of the magenta image carrier 12*c* with respect to the black image carrier 12*a*. I the present example, since the rotational phase of the black image carrier 12*a* is calculates as 0° and the rotational phase of the magenta image carrier 12*c* is calculated as 300°, the relative phase value of the magenta image carrier 12*c* with respect to the black image carrier 12*a* is calculated as 300°.

Then, the above-described processes of steps S2 through S13 are performed with respect to a combination of the black image carrier 12*a* and the cyan image carrier 12*b* and a combination of the black image carrier 12*a* and the yellow image carrier 12*d* so that the relative phase values of the cyan image carrier 12*b* and the yellow image carrier 12*d* with respect to the black image carrier 12*a* may be obtained (step S14, YES). In the present example, it is assumed that the relative phase value of the cyan image carrier 12*b* with respect to the black image carrier 12*a* is 90°, and the relative phase value of the yellow image carrier 12*d* with respect to the black image carrier 12*a* is 180°.

Then, the drum drive unit 108 starts drive operations of the image carriers 12*a*-12*d* so that the mark detecting unit 111 may detect the markings 22 of the image carriers 12*a*-12*d*, and then stops the image carriers 12*a*-12*d* at appropriate positions based on their corresponding relative phase values that are calculated in step S13 (step S15).

Figure 17:
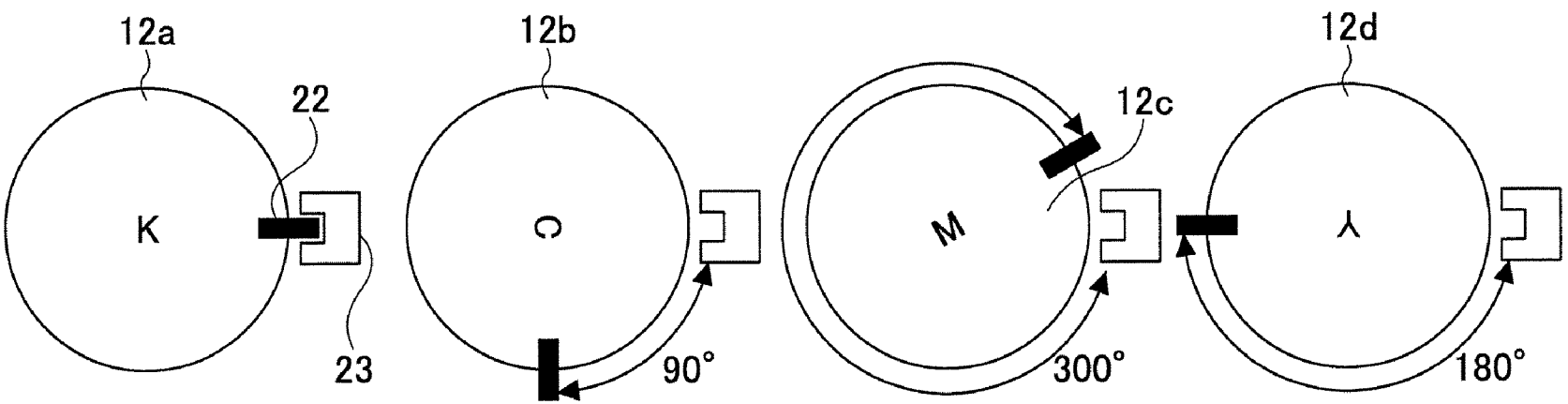
FIG. 17 is a diagram illustrating positions of image carriers after rotational phase adjustment operations are performed thereon.

FIG. 17 is a diagram illustrating the positions of the image carriers 12*a*-12*d* after the above-described rotational phase adjustment operations are performed. Specifically, in FIG. 17, the black image carrier 12*a* is stopped at 0° (i.e., when the position of its marking 22 corresponds to the position of the image carrier position sensor 23), the cyan image carrier 12*b* is stopped when its marking 22 is positioned away from the image carrier position sensor 23 by 90°, the magenta image carrier 12*c* is stopped when its marking 22 is positioned away from the image carrier position sensor 23 by 300°, and the yellow image carrier 12*d* is stopped when its marking 22 is positioned away from the image carrier position sensor 23 by 180°.

As can be appreciated from the above descriptions, according to an aspect of the present embodiment, rotational phase adjustment of the image carriers 12*a*-12*d* that are exchanged in the printer 1 may be performed by simultaneously reading detection patterns of two colors, namely black and another color, in one operations sequence for printing and detecting the detection patterns of the black image carrier 12*a* and another image carrier, wherein the operations sequence are repeated three times while sequentially switching the color of the non-black detection patterns. In this way, positional deviation and color drift variation components occurring within the printer 1 may be accurately detected and reduced in an inexpensive manner. It is noted that although the phase detection operations are described above as service mode operations to be executed by a serviceperson, the present invention is not limited to such an embodiment.

According to another aspect of the present embodiment, by performing pattern printing and reading of two colors at the same time in one operations sequence, rotational variation components may be accurately detected and adjusted without inducing significant cost increase, for example. It is noted that when pattern printing and reading of four colors are performed at the same time, four sets of detection sensors (pattern detecting units), sampling process circuits, and memory areas are required so that costs may be significantly increased.

According to another aspect of the present embodiment, since the phase detection operations are performed when the image carriers 12*a*-12*d* are exchanged in the printer 1, the phase detection operations does not have to be performed very frequently. That is, the phase detection operations may merely be a part of maintenance service operations performed by a serviceperson, for example. In other words, since the phase detection operations are not performed by the user in the present embodiment, an increase in the detection process time may be tolerated to some extent. Thus, the phase detection operations according to the present embodiment may be enabled by a relatively inexpensive configuration to thereby prevent cost increase, for example.

According to another aspect of the present embodiment, by repeating the pattern printing and detection operations sequence three times and calculating the relative phase values of the image carriers 12*a*-12*d*, detection errors may be reduced and variation components may be accurately detected and adjusted. Specifically, it is noted that the time it takes for actually starting printing operations from the rotation activation of the image carriers 12*a*-12*d* is managed by software so that such a time may not always be the same. Accordingly, although absolute phase values of the image carriers 12*a*-12*d* may be calculated by performing the pattern printing and detecting operations sequence merely two times (e.g., first with respect to the black image carrier 12*a* and the cyan image carrier 12*b*, and then with respect to the magenta image carrier 12*c* and the yellow image carrier 12*d*), in this case detection errors may be created owing to the variations in the printing start time, for example. According to the above-described embodiment, the black image carrier 12*a* is used as a reference and a difference between the black image carrier 12*a* and each of the image carriers 12*b*-12*d* is detected to obtain relative phase values of the image carriers 12*b*-12*d* with respect to the black image carrier 12*a* so that detection errors may be reduced. It is noted that although the black image carrier 12*a* is used as a reference in the above-described embodiment, the present invention is not limited to such an embodiment and an image carrier in any one of plural colors may be used as a reference.

According to another aspect of the present embodiment, in step S2, the pattern length Pa may be set to a common multiple of the rotational variation period of the image carriers 12*a*-12*d* and the rotational variation period of the drive roller 14, which has a greater rotation variation period than that of the image carriers 12*a*-12*d*. For example, in a case where the diameter of the image carriers 12*a*-12*d* is 40 mm and the diameter of the drive roller 14 is 30 mm, the rotational periods of the image carriers 12*a*-12*d* and the drive roller 14 converted into distances on the intermediate transfer belt 16 are $40\times\pi\approx125.7$ mm and $30\times\pi\approx94.2$ mm, respectively. In this case, the pattern length Pa may be set to 376.8 mm corresponding to a common multiple of the above rotational periods of the image carriers 12*a*-12*d* and the drove roller 14.

It is noted that in step S11 of the present embodiment, although phase value calculation is performed at sampling timings with respect to all data extracted in step S10, such a calculation scheme may not cause substantial problems with regard to detection accuracy, for example, since only the phase value of the relevant variation component is calculated/used. On the other hand, if the amplitude is used to control the motor speed, for example, speed conversion of relevant parameters may have to be performed.

Although the present invention is shown and described with respect to certain preferred embodiments, it is obvious that equivalents and modifications may occur to others skilled in the art upon reading and understanding the specification. The present invention includes all such equivalents and modifications, and is limited only by the scope of the claims.

The present application is based on and claims the benefit of the earlier filing date of Japanese Patent Application No. 2006-075652 filed on Mar. 17, 2006, the entire contents of which are hereby incorporated by reference.

What is claimed is:

1. An imaging apparatus comprising:

a plurality of image carriers on which a plurality of different-colored toner images are formed, the image carriers being driven and rotated to transfer the different-colored toner images onto one of an endless transfer member that is driven to rotate in contact with the image carriers or a transfer material that is carried by the endless transfer member;

a pattern forming unit configured to form detection patterns on the endless transfer member, the detection patterns being formed with distances separating detection patterns;

a phase calculating unit that extracts a periodic rotational variation component of each of the image carriers, based on the distances between the detection patterns on the endless transfer member, from a combination of periodic rotational variation components generated within said imaging apparatus and calculates a rotational phase of each of the image carriers based on the extracted periodic rotational variation component; and a rotational phase adjusting unit that adjusts a rotation stop phase of each of the image carriers based on the calculated rotational phase, wherein the phase calculating unit divides the combination of periodic rotational variation components generated within said imaging apparatus into an in-phase component and a quadrature component of a rotational period of each of the image carriers and calculates the rotational phase of each of the image carriers based on the in-phase component and the quadrature component of the rotational period.

2. The imaging apparatus as claimed in claim 1, wherein the rotational phase adjusting unit adjusts the rotation stop phase of each of the image carriers using one of the image carriers as a reference.

3. The imaging apparatus as claimed in claim 1, wherein the rotational phase adjusting unit uses a rotational phase of one of the image carriers as a reference, obtains a difference between the rotational phase of said one of the image carriers and a rotational phase of another one of the image carriers, and adjusts the rotation stop phase of each of the image carriers based on the obtained difference.

4. The imaging apparatus as claimed in claim 1, further comprising:

a pattern detecting unit that detects a detection pattern formed by the pattern forming unit; and a detection time measuring unit that measures a detection time at which the detection pattern is detected by the pattern detecting unit; wherein the combination of periodic rotational variation components generated within said imaging apparatus corresponds to a plurality of the detection times measured by the detection time measuring unit; and the phase calculating unit extracts the periodic rotational variation component of each of the image carriers from the detection times measured by the detection time measuring unit and calculates the rotational phase of each of the image carriers.

5. The imaging apparatus as claimed in claim 4, further comprising:

a counter; wherein the detection time measured by the detection time measuring unit corresponds to a value indicated by the counter at one of a rising edge timing or a falling edge timing of a pattern detection signal representing a detection status of the pattern detection unit.

6. The imaging apparatus as claimed in claim 4, further comprising:

a counter; wherein the detection time measured by the detection time measuring unit corresponds to a median value of a first value and a second value of the counter that are respectively indicated at a rising edge timing and a falling edge timing of a pattern detection signal representing a detection status of the pattern detection unit.

7. The imaging apparatus as claimed in claim 4, further comprising:

a marking arranged at each of the image carriers which marking indicates a rotating position of each of the image carriers; and a mark detecting unit that detects the marking of each of the image carriers; wherein the detection pattern forming unit starts forming the detection pattern according to a detection result of the mark detecting unit.

8. The imaging apparatus as claimed in claim 7, wherein the pattern forming unit starts forming the detection pattern when the mark detecting unit detects the marking.

9. The imaging apparatus as claimed in claim 7, wherein the rotational phase adjusting unit adjusts the rotation stop phase of each of the image carriers based on the rotational phase of each of the image carriers calculated by the phase calculating unit and the detection result of the mark detecting unit.

10. The imaging apparatus as claimed in claim 9, wherein the rotational phase adjusting unit stops rotation of the image carriers after the mark detecting unit detects the marking of each of the image carriers, the image carriers being stopped according to the rotational phase of each of the image carriers calculated by the phase calculating unit.

11. The imaging apparatus as claimed in claim 4, wherein the detection pattern corresponds to a plurality of toner patterns that are equidistantly arranged over a length equal to an integer multiple of a perimeter of the image carriers.

12. The imaging apparatus as claimed in claim 4, wherein the detection pattern corresponds to a plurality of toner patterns that are equidistantly arranged over a length equal to a common multiple of a perimeter of the image carriers and a perimeter of at least another rotating element.

13. The imaging apparatus as claimed in claim 1, wherein the image carriers are cylindrical rotating elements.

* * * * *